US007810689B2

(12) United States Patent
Kumayama

(10) Patent No.: US 7,810,689 B2
(45) Date of Patent: Oct. 12, 2010

(54) STAPLER

(75) Inventor: Michihito Kumayama, Tokyo (JP)

(73) Assignee: Sebek Limited, Tokyo (JP)

( * ) Notice: Subject to any disclaimer, the term of this patent is extended or adjusted under 35 U.S.C. 154(b) by 639 days.

(21) Appl. No.: 11/658,529

(22) PCT Filed: May 25, 2005

(86) PCT No.: PCT/JP2005/009557

§ 371 (c)(1),
(2), (4) Date: Jan. 25, 2007

(87) PCT Pub. No.: WO2006/126262

PCT Pub. Date: Nov. 30, 2006

(65) Prior Publication Data

US 2008/0302850 A1 Dec. 11, 2008

(51) Int. Cl.
*B25C 5/11* (2006.01)
*B27F 7/32* (2006.01)

(52) U.S. Cl. ..... 227/111; 227/120; 227/140

(58) Field of Classification Search ..... 227/111, 227/120, 140
See application file for complete search history.

(56) References Cited

U.S. PATENT DOCUMENTS 2,940,079 A * 6/1960 Langford ..... 227/120
4,111,080 A * 9/1978 Pray ..... 29/243.51
4,333,217 A * 6/1982 Pray ..... 29/243.51
4,838,470 A * 6/1989 Chang ..... 227/120
5,024,486 A * 6/1991 Auel ..... 297/330
5,492,261 A * 2/1996 Chi ..... 227/128
5,497,931 A * 3/1996 Nakamura ..... 227/109
5,758,813 A * 6/1998 Kikuchi et al. ..... 227/155
6,123,329 A * 9/2000 Sato et al. ..... 271/9.01
6,179,193 B1 * 1/2001 Nagai ..... 227/123
6,270,268 B1 * 8/2001 Kawabe ..... 400/488
6,918,525 B2 * 7/2005 Marks ..... 227/120
6,942,136 B2 * 9/2005 Tsai ..... 227/155

(Continued)

FOREIGN PATENT DOCUMENTS

JP 63-278770 11/1988

(Continued)

OTHER PUBLICATIONS

English language International Search Report Form PCT/ISA/210 (second sheet) for PCT/JP2005/009557.

(Continued)

*Primary Examiner*—Paul R. Durand
*Assistant Examiner*—Gloria R. Weeks
(74) *Attorney, Agent, or Firm*—Staas & Halsey LLP

(57) ABSTRACT

A stapler that can push staples into a surface of a paper bundle regardless of thickness of the paper bundle is provided. An exemplary embodiment of the stapler includes a vertical movement section for causing an operating handle to vertically descend together with a staple mounting magazine by pressing the operating handle while keeping the operating handle at a predetermined angle, a post-vertical movement rotating section for causing the operating handle to rotate after the staple mounting magazine vertically descends to come into contact with the paper bundle placed on a horizontal base, and a vertical position fixing section for fixing a vertical position of the staple mounting magazine by starting the rotation of the operating handle.

17 Claims, 19 Drawing Sheets

U.S. PATENT DOCUMENTS

| | | | | |
|---|---|---|---|---|
| 7,080,768 | B2 * | 7/2006 | Marks | 227/120 |
| 7,178,709 | B2 * | 2/2007 | Marks | 227/107 |
| 7,438,206 | B2 * | 10/2008 | Kumayama | 227/127 |
| 2004/0232192 | A1 * | 11/2004 | Marks | 227/120 |
| 2005/0082335 | A1 * | 4/2005 | Tsai | 227/134 |
| 2006/0213950 | A1 * | 9/2006 | Marks | 227/134 |
| 2007/0023474 | A1 * | 2/2007 | Smith et al. | 227/155 |
| 2007/0125823 | A1 * | 6/2007 | Marks | 227/132 |
| 2008/0302850 | A1 * | 12/2008 | Kumayama | 227/120 |
| 2009/0014496 | A1 * | 1/2009 | Kumayama | 227/125 |
| 2009/0072003 | A1 * | 3/2009 | Matsukawa | 227/120 |
| 2009/0152318 | A1 * | 6/2009 | Matsukawa | 227/129 |

FOREIGN PATENT DOCUMENTS

| | | |
|---|---|---|
| JP | 6-285772 | 10/1994 |
| JP | 3031392 | 9/1996 |
| JP | 8-318475 | 12/1996 |
| JP | 2000-24956 | 1/2000 |
| JP | 2005-34966 | 2/2005 |

OTHER PUBLICATIONS

English language Abstract of WO 9839143 published Sep. 11, 1998.
English language translation of International Preliminary Report on Patentability for corresponding International Patent Application No. PCT/JP2005/009557 mailed Dec. 13, 2007.

* cited by examiner

FIG.12A
FIG.12B
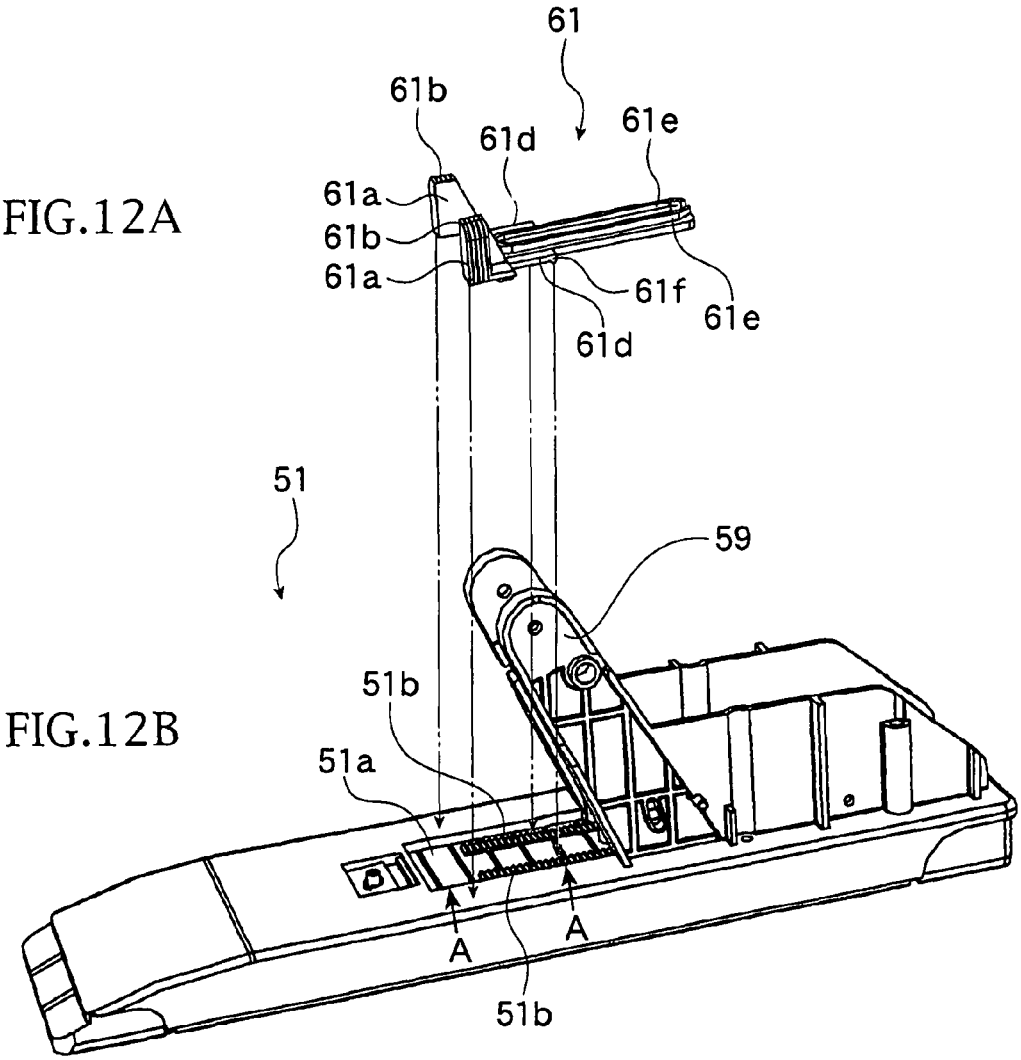
FIG.12C
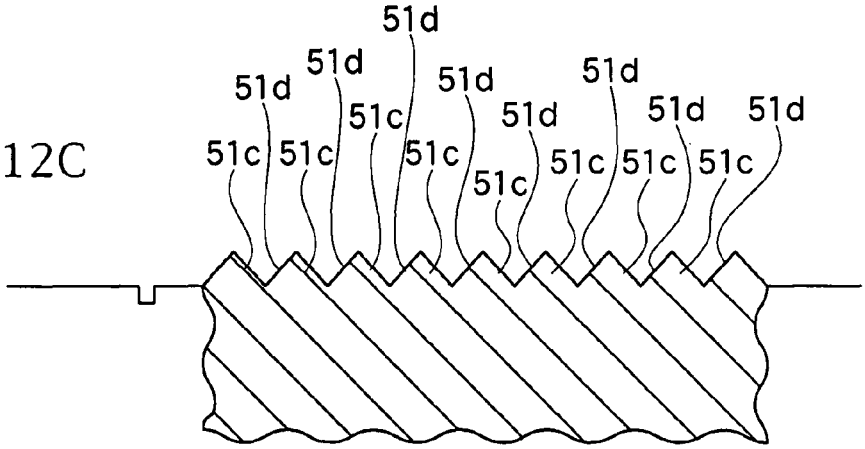

STAPLER

TECHNICAL FIELD

The present invention relates to a stapler including a horizontal base, an operating handle, a staple pushing blade, and a staple mounting magazine to mount a staple connecting assembly cassette housing a staple connecting assembly that connects many staples.

BACKGROUND ART

In a conventional stapler, a staple mounting magazine housing a staple connecting assembly is fixed to a horizontal base by a main shaft and an operating handle that is rotatable around the main shaft is provided. Then, if the operating handle is rotated around the main shaft, a staple mounted in the staple mounting magazine is brought into contact with a surface of a paper bundle placed on the horizontal base before the paper is stapled.

However, since the operating handle rotates around a specific one point, the inclination of a staple pushed out of the staple mounting magazine is not constant depending on thickness of the paper bundle, posing a possibility of irregularly stapled paper bundle.

Staplers constructed to be able to push legs of a staple perpendicularly to the paper to prevent such a possibility are available and an invention relating to such staplers is described, for example, in Patent Document 1.

Patent Document 1 discloses a stapler constructed to "hold a paper receiving rear table in a horizontal position and a paper receiving front table slightly tilted forward, cause a guide plate set up in a rear end portion of one side wall of a slider to project by inserting the guide plate through an opening of the paper receiving rear table to make lower end portions of operating pieces to attach to/detach from the guide plate, and move the slider backward by pressing the guide plate via the lower end portions of the operating pieces when a handle is operated by pressure, thereby releasing right and left ends of a bending table retaining body placed on the front end portions of both side walls of the slider so that legs of a staple are bent slightly obliquely in parallel and flatly."

According to Patent Document 1, "since a pedestal, the paper receiving rear table, and a frame are centrally connected by one main shaft, the handle is connected to a portion of the frame via a spindle, and so there is only one fulcrum of the main shaft, the frame and a staple bending table attached to the paper receiving rear table move together in a backward direction when stapling by separating a staple through a handle operation. Thus, a positional relationship between a paper bundle and staples sandwiched by the frame and the staple bending table is maintained so that staples can always be bent precisely and smoothly."

Some types of conventional staplers have a structure in which the staple mounting magazine is pivotally supported with respect to the horizontal base and the operating handle is pivotally supported with respect to the staple mounting magazine.

However, if the operating handle is rotated, a shaft portion that pivotally supports the operating handle with respect to the staple mounting magazine will lift up the staple mounting magazine by the principle of leverage. Thus, a stapler whose operating handle can be rotated with a small force while preventing the staple mounting magazine from being lifted up by rotation of the operating handle is preferable. An invention relating to such staplers is described, for example, in Patent Document 2.

Patent Document 2 discloses a stapler in which a handle frame 6 is pivotally supported by a third spindle with respect to a support piece provided on a horizontal base (base frame). According to Patent Document 2, the stapler is considered to be able to push a staple into a paper bundle easily with a small force because an operating handle is rotated.

Further, conventional staplers have a paper end guide provided so that one edge of a paper bundle can be aligned before pushing staples to positions to be stapled. Inventions relating to the paper end guide are described, for example, in Patent Document 3 and Patent Document 4.

"A paper end guide reciprocating back and forth is slidably provided" is described in 10th to 12th lines in a right column on page 2 of Patent Document 3. According to Patent Document 3, the paper end guide is considered to be able to align one edge of a paper bundle and also, by moving the paper end guide, to adjust a stapling position of a staple in the paper bundle to a desired position apart from one edge of the paper bundle with a predetermined distance.

"By lifting up the pressing blade guide 17 of the staple mounting magazine, a convex portion of the pressing blade guide engaged with a concave portion of a notch of the outer frame 11 is removed from the concave portion to move up and the back side of a staple discharge port is opened so that a staple hooked on a staple outlet is spontaneously discharged from the staple discharge port by an energizing force of a rail caused by a spring" is described in 23rd line on page 13 to 9th line on page 14 of Patent Document 4.

Patent Document 1: Japanese Utility Model Registration No. 3,031,392

Patent Document 2: Japanese Patent Application Laid-Open No. 2005-034966.

Patent Document 3: Japanese Patent Application Laid-Open No. 6-285772

Patent Document 4: PCT Publication No. WO 98/039143.

DISCLOSURE OF THE INVENTION

Problem to be Solved by the Invention

According to the inventions described in Patent Document 1 and Patent Document 2, the frame and the staple bending table attached to the paper receiving rear table move together in the backward direction to retain the positional relationship between a paper bundle and staples sandwiched by the frame and the staple bending table unchanged before the paper bundle is stapled. However, there is a possibility that a staple is caused to descend with a tilt with respect to the paper bundle and a staple tip is driven obliquely with respect to the paper bundle before being stapled so that the paper bundle is stapled with irregularities.

Particularly, a staple can be caused to descend perpendicularly to a paper bundle only if a distance between a lower end portion of a front frame provided in a front end portion of the frame from which a staple is pushed out and the paper receiving rear table or paper receiving front table is equal to the thickness of the paper bundle, and, for any other thickness of the paper bundle, there is a possibility that the paper bundle is stapled with irregularities.

According to the invention described in Patent Document 2, the operating handle is pivotally supported with respect to the horizontal base. Since the pivotally supported position does not change during operation of the operating handle, if such a pivotally supported position can be caused to descend in accordance with the thickness of the paper bundle, a paper bundle can presumably be stapled by rotating the operating handle with a smaller amount of operation or a smaller force.

If, on the other hand, a staple is discharged by rotating the operating handle without putting a paper bundle between the staple mounting magazine and horizontal base (hereinafter referred to as "push a staple on a trial basis"), a stapler described in Patent Document 3 has no function to push a staple on trial base so that pushing a staple on a trial base is only carried out by making it impossible for the staple mounting magazine to descend by putting for example, a ball-point pen between the staple mounting magazine and horizontal base.

Further, when a stapler described in Patent Document 4 pushes a staple on a trial basis, troublesome work to attach/detach a pressing blade guide to/from the staple mounting magazine is needed, and also manufacturing costs add up due to a complicated structure.

Then, an object of the present invention is to provide a stapler that can push a staple perpendicularly to a surface of a paper bundle regardless of thickness of the paper bundle.

Another object of the present invention is to provide a stapler whose operating handle can be operated with a small force and movement by making a position of a rotating shaft of the operating handle lower in accordance with the thickness of the paper bundle.

Still another object of the present invention is to provide a stapler in which pushing a staple on a trial basis can be conducted easily and the cost of manufacturing the stapler can be reduced.

Means for Solving the Problems

To solve problems described above, in a first aspect of the present invention, a stapler including a horizontal base, an operating handle arranged by tilting to a predetermined angle with respect to the horizontal base, a staple mounting magazine attached to the operating handle to mount a staple connecting assembly cassette housing a staple connecting assembly that connects many staples, and a staple pushing blade which is brought down on a staple housed in the staple mounting magazine, includes vertical movement means for causing the operating handle to vertically descend together with the staple mounting magazine by pressing the operating handle while keeping the operating handle at a predetermined angle and post-vertical movement rotating means that can start rotation of the operating handle after the staple mounting magazine vertically descends to come into contact with a paper bundle placed on the horizontal base.

In a second aspect of the present invention, in addition to a configuration described in the first aspect, the stapler includes magazine vertical position fixing means for fixing a vertical position of the staple mounting magazine by starting the rotation of the operating handle.

In a third aspect of the present invention, in addition to the configuration described in the first aspect, the vertical movement means is a pantograph causing the staple mounting magazine to descend and ascend on the horizontal base.

In a fourth aspect of the present invention, in addition to the configuration described in the first aspect, the post-vertical movement rotating means includes a vertical direction elastic member supporting the staple mounting magazine and a rotation direction elastic member rotating the operating handle, and the rotation direction elastic member elastically deforms to start the rotation of the operating handle after the vertical direction elastic member elastically deforms and the operating handle descends together with the staple mounting magazine to come into contact with the paper bundle while keeping the operating handle at a predetermined angle.

In a fifth aspect of the present invention, in addition to the configuration described in the second aspect, the magazine vertical position fixing means includes a support member set up on the horizontal base and a key member movable along the support member, and a position in a vertical direction of the staple mounting magazine is fixed with the key member being engaged with the support member.

In a sixth aspect of the present invention, in addition to the configuration described in the fifth aspect, a fixed spring assisting in engagement with the support member is in contact with the key member to strengthen a force of the key member to engage with the support member.

In a seventh aspect of the present invention, in addition to the configuration described in the fifth aspect, the key member includes a vertical portion, a load receiving portion bent at an upper end portion of the vertical portion to receive a load of the operating handle, and an engaging plate portion bent at a lower end portion of the vertical portion and having an insertion hole with which the support member can be engaged and is formed in a C cross-sectional shape.

In an eighth aspect of the present invention, in addition to the configuration described in the seventh aspect, the fixed spring is compressed and disposed between a bearing portion of the support member formed in a key member housing portion housing the key member and the support member provided in the staple mounting magazine and the engaging plate.

In a ninth aspect of the present invention, in addition to the configuration described in the seventh aspect, a load transmission portion to transmit a load on the operating handle to the key member is formed in the operating handle, the load receiving portion and the load transmission portion are provided face to face with each other, the load transmission portion moves away from the load receiving portion, the engaging plate and the support member engage with each other, and movement of the key member with respect to the support member is stopped when the operating handle is rotated, and the load transmission portion is pushed against the load receiving portion to release engagement between the engaging plate and the support member, and the key member can move with respect to the support member when the operating handle is not rotated.

In a tenth aspect of the present invention, in addition to the configuration described in the first aspect, a blade pusher pressing to cause the staple pushing blade to descend is rockable without support of an upper end portion thereof by the operating handle, and a convex portion formed in areas other than the upper end portion is supported by the operating handle.

In an eleventh aspect of the present invention, in addition to the configuration described in the tenth aspect, the convex portion is an insertion convex portion formed on the blade pusher, the insertion convex portion is inserted through a guidance slotted hole formed inside a blade guide portion of the staple mounting magazine and fitted into a fitting member, and a support hole to support the fitting member is formed in the staple mounting magazine so that the operating handle rotates while the fitting member and the support hole are at least in point contact.

In a twelfth aspect of the present invention, in addition to the configuration described in the tenth or eleventh aspect, a position of a midway point between an upper end and a lower end of positions where the convex portion moves before and after descent/ascent by an operation of the operating handle is approximately as high as the rotating shaft of the operating handle.

In a thirteenth aspect of the present invention, a stapler including a horizontal base, an operating handle arranged by tilting to a predetermined angle with respect to the horizontal base, a staple mounting magazine attached to the operating handle to mount a staple connecting assembly cassette housing a staple connecting assembly that connects many staples, and a staple pushing blade which is designed to be brought down on a staple housed in the staple mounting magazine, includes a paper end guide including a horizontal portion moving on the horizontal base and a vertical portion bent from the horizontal portion and formed in an L shape as a side view to adjust a stapling position of a paper bundle by the vertical portion and convex portions formed in a portion of the staple mounting magazine, wherein the staple can be pushed on a trial basis by bringing an upper end of the vertical portion and a lower end of the convex portions into contact.

In a fourteenth aspect of the present invention, in addition to the configuration described in the thirteenth aspect, the convex portions are formed near a staple discharge port of the staple mounting magazine.

In a fifteenth aspect of the present invention, in addition to the configuration described in the thirteenth or fourteenth aspect, a guide rail portion for guiding the paper end guide having a plurality of concave portions is provided along a longitudinal direction of the horizontal base, and an engaging claw that can be engaged with the concave portions is formed in the paper end guide.

In a sixteenth aspect of the present invention, in addition to the configuration described in the thirteenth to fifteenth aspects, a concave portion is formed at the upper end of the vertical portion of the paper end guide.

In a seventeenth aspect of the present invention, in addition to the configuration described in the thirteenth to fifteenth aspects, a back side of the paper end guide is formed of a magnet, and an upper surface of the horizontal base is formed of an iron plate to which the magnet is detachably attached.

In an eighteenth aspect of the present invention, in addition to the configuration described in the first aspect, the stapler includes a rotating shaft vertical position fixing means for fixing a height of a rotating shaft of the operating handle by starting rotation of the operating handle.

In a nineteenth aspect of the present invention, in addition to the configuration described in the eighteenth aspect, the rotating shaft vertical position fixing means includes a support member set up on the horizontal base, a key member movable along the support member, a bearing member supporting the key member, a hole formed in the bearing member to be inserted through by the rotating shaft of the operating handle, and the rotating shaft of the operating handle.

In a twentieth aspect of the present invention, in addition to the configuration described in the eighteenth aspect, an elastic member for transmitting a pressing force applied to the operating handle to the staple mounting magazine is provided between the operating handle and the staple mounting magazine.

In a twenty-first aspect of the present invention, in addition to the configuration described in the nineteenth aspect, a fixed spring assisting in engagement with the support member is in contact with the key member to strengthen a force of the key member to engage with the support member.

In a twenty-second aspect of the present invention, in addition to the configuration described in the nineteenth aspect, the key member includes a vertical portion and an engaging plate bent from a lower end portion of the vertical portion to have an insertion hole with which the support member can engage and is formed in an L cross-sectional shape, a key member housing portion in which the support member and the key member are housed is provided in the staple mounting magazine, and the bearing member supporting the key member is provided in the key member housing portion.

In a twenty-third aspect of the present invention, in addition to the configuration described in the twentieth aspect, the elastic member is a spring member in a V-shape, and between the operating handle and the staple mounting magazine, one end of the spring member is attached to the operating handle and the other end of the spring member is attached to the staple mounting magazine.

EFFECT OF THE INVENTION

In accordance with the first aspect of the present invention, the stapler includes vertical movement means for causing the operating handle to vertically descend together with the staple mounting magazine by pressing the operating handle while keeping the operating handle at the predetermined angle and post-vertical movement rotating means that can start rotation of the operating handle after the staple mounting magazine vertically descends to come into contact with a paper bundle placed on the horizontal base. Thus, a staple, after being guided to a vicinity of a surface of the paper bundle while mounted in the staple mounting magazine, is pushed into the surface of the paper bundle by rotating the operating handle. Therefore, the paper bundle is not stapled obliquely and irregularities of the stapled paper bundle can be prevented.

In accordance with the second aspect of the present invention, the stapler includes magazine vertical position fixing means for fixing the vertical position of the staple mounting magazine by starting the rotation of the operating handle. Thus, after being felt that the staple mounting magazine has been brought into contact with the surface of the paper bundle, the staple can be pushed into the paper bundle by rotating the operating handle. Therefore, a timing when a staple should be pushed into the paper bundle becomes easier to understand.

In accordance with the third aspect of the present invention, the vertical movement means is a pantograph causing the staple mounting magazine to descend and ascend on the horizontal base. Thus, the staple mounting magazine is caused to descend and ascend while keeping a parallel state with the horizontal base by operating a pantograph mechanism. Therefore, a structure of descent and ascent of the staple mounting magazine can be simplified.

In accordance with the fourth aspect of the present invention, the post-vertical movement rotating means includes a vertical direction elastic member supporting the staple mounting magazine and a rotation direction elastic member rotating the operating handle. Thus, after the vertical direction elastic member elastically deforms and the operating handle descends together with the staple mounting magazine by keeping a predetermined angle to come into contact with a paper bundle, the rotation direction elastic member elastically deforms to start rotation of the operating handle. Therefore, it becomes possible to cause a staple to descend vertically before the staple comes into contact with the paper bundle and then to push the staple into the surface of the paper bundle so that the paper bundle can be stapled vertically.

In accordance with the fifth aspect of the present invention, the magazine vertical position fixing means includes a support member set up on the horizontal base to guide vertical movement of the staple mounting magazine and a key member movable along the support member. Thus, the staple mounting magazine can descend and ascend while the key member is not engaged with the support member and the position of the staple mounting magazine in the vertical direction is fixed while the key member is engaged with the support member. Therefore, the key member can stop movement of the support member at any position in the vertical direction to fix the position so that the staple mounting magazine can be fixed at an appropriate height in accordance with thickness of the paper bundle.

In accordance with the sixth aspect of the present invention, a fixed spring assisting in engagement with the support member is in contact with the key member to strengthen a force of the key member to engage with the support member. Therefore, the key member cannot descend and ascend from a predetermined position of the support member.

In accordance with the seventh aspect of the present invention, the key member includes a vertical portion, a load receiving portion bent at an upper end portion of the vertical portion to receive a load of the operating handle, and an engaging plate bent from a lower end portion of the vertical portion to have an insertion hole with which the support member can engage and is formed in a C cross-sectional shape. Thus, a structure for causing the key member to engage with the support member becomes simpler, and molding the key member is easy.

In accordance with the eighth aspect of the present invention, the fixed spring is disposed by applying a compressive force between a bearing portion of the support member formed in a key member housing portion housing, the key member and the support member provided in the staple mounting magazine and the engaging plate. Thus, when the fixed spring expands, the key member is tilted and the insertion hole is engaged with a flank of the upper round bar so that the staple mounting magazine can be fixed.

In accordance with the ninth aspect of the present invention, a load transmission portion to transmit a load on the operating handle to the key member is formed on the back side of the operating handle and the load receiving portion and the load transmission portion are provided face to face with each other. Thus, when the operating handle is rotated, the load transmission portion moves away from the load receiving portion, the engaging plate and support member engage with each other, and movement of the key member with respect to the support member is stopped. When the operating handle is not rotated, the load transmission portion is pushed against the load receiving portion to release engagement between the engaging plate and support member and the key member can move with respect to the support member. Therefore, when rotation of the operating handle is started, the staple mounting magazine is positioned, and when the operating handle does not rotate, the staple mounting magazine can descend and ascend.

In accordance with the tenth aspect of the present invention, the blade pusher pressing to cause the staple pushing blade to descend is rockable without support of an upper end portion thereof by the operating handle, and a convex portion formed in other areas than the upper end portion is supported by the operating handle. Thus, the bending moment applied to the staple pushing blade does not grow large when the operating handle is rotated unlike a conventional type moving the upper end of the staple pushing blade along the back side of the operating handle. Therefore, disengage of the staple pushing blade from the operating handle and wear of the staple pushing blade can be prevented unlike a conventional type moving the upper end of the staple pushing blade along the back side of the operating handle.

In accordance with the eleventh aspect of the present invention, the convex portion is an insertion convex portion formed on the blade pusher, the insertion convex portion is inserted through a guidance slotted hole formed inside a blade guide portion of the staple mounting magazine and a fitting member is fitted into the insertion convex portion, and a support hole to support the fitting member is formed in the staple mounting magazine so that the operating handle rotates while the fitting member and the support hole are at least in point contact. Thus, if the operating handle is rotated, the support hole rotates around the fitting member while at least in point contact with the fitting member. Therefore, a contact surface between the support hole and fitting member is minimum and friction becomes smaller, and thus the operating handle rotates easily to allow improvement of operability of the operating handle.

In accordance with the twelfth aspect of the present invention, the position of a midway point between the upper end and lower end of positions where the convex portion moves before and after descent/ascent by an operation of the operating handle is approximately as high as the rotating shaft of the operating handle. Thus, the moving direction of a portion of the staple pushing blade where the staple pushing blade is supported is directed in the vertical direction when the operating handle is rotated in comparison with a case in which the upper end portion of the staple pushing blade is supported. Therefore, a lateral component of force that arises when the staple pushing blade is brought down becomes smaller in comparison with the case in which the upper end portion of the staple pushing blade is supported, allowing to make a load on the staple pushing blade smaller.

In accordance with the thirteenth aspect of the present invention, the stapler includes a paper end guide including a horizontal portion moving on the horizontal base and a vertical portion bent from the horizontal portion and formed in an L shape as a side view to adjust a stapling position of a paper bundle by the vertical portion and convex portions formed in a portion of the staple mounting magazine. Thus, by moving the vertical portion on the horizontal base to below the convex portions of the staple mounting magazine, being blocked by the vertical portion of the paper end guide, the staple mounting magazine can be made not to descend to the horizontal base even if the operating handle is rotated. Therefore, staples can be pushed on a trial basis even if there is no paper bundle between the staple mounting magazine and horizontal base.

In accordance with the fourteenth aspect of the present invention, the convex portions are formed near a staple discharge port of the staple mounting magazine. Thus, if the vertical portion of the paper end guide is caused to move to a vicinity of the staple discharge port, the convex portions of the staple mounting magazine and the vertical portion of the paper end guide can come into contact as the staple mounting magazine descends. Therefore, if an operator of the stapler brings the vertical portion of the paper end guide closer to the staple discharge port, it can easily be recognized that staples can be pushed on a trial basis, instead of being enable to normally push staples.

In accordance with the fifteenth aspect of the present invention, a guide rail portion for guiding the paper end guide having a plurality of concave portions is provided along a longitudinal direction of the horizontal base, and an engaging claw that can be engaged with the concave portions is formed in the paper end guide. Thus, when pushing staples on a trial basis, the engaging claw of the paper end guide is engaged with the concave portions provided in the guide rail portion on the horizontal base so that the paper end guide can reliably be fixed onto the horizontal base. Therefore, there is no possibility of the paper end guide being moved when setting a paper bundle to the stapler in order to make paper edges of the paper bundle to be stapled aligned.

In accordance with the sixteenth aspect of the present invention, a concave portion is formed at the upper end of the vertical portion of the paper end guide. Thus, when the staple mounting magazine is caused to descend, the convex portions of the staple mounting magazine are reliably fitted into the concave portions of the paper end guide. Therefore, if the staple mounting magazine is caused to descend to push staples on a trial basis, since no shift can be caused after the convex portions of the staple mounting magazine are fitted into the engaged concave portions of the paper end guide, the paper end guide does not move on the horizontal base and staples can reliably be pushed on a trial basis without causing arrangement shifts between the vertical portion of the paper end guide and the convex portions of the staple mounting magazine.

In accordance with the seventeenth aspect of the present invention, the back side of the paper end guide is formed of magnets, and the upper surface of the horizontal base is formed of an iron plate to which the magnets are attached. Thus, it is possible to remove the paper end guide from the horizontal base against a magnetic force to move it to a location on the horizontal base where the paper end guide should be moved and to fix the paper end guide to a desired location on the horizontal base by the magnetic force. Therefore, time and effort to fix one end of a spring to a hole formed in the horizontal base and the other end of the spring to the paper end guide as conventional technique can be skipped. That is, there is neither need for forming a hole for fixing a spring in the horizontal base nor spring itself. The paper end guide can reliably be fixed on the horizontal base, and also the paper end guide can be moved on the horizontal base by easily removing the paper end guide.

In accordance with the eighteenth aspect of the present invention, the stapler includes a rotating shaft vertical position fixing means for fixing a height of the rotating shaft of the operating handle by starting rotation of the operating handle. Thus, it can be made easier to recognize a timing when a staple can be pushed vertically into a paper bundle.

In accordance with the nineteenth aspect of the present invention, the rotating shaft vertical position fixing means includes a support member set up on the horizontal base, a key member movable along the support member, a bearing member supporting the key member, a hole formed in the bearing member to be inserted through by the rotating shaft of the operating handle, and the rotating shaft of the operating handle. Thus, the key member is engaged with the support member, and the bearing member is fixed by fixing the key member, thereby fixing the rotating shaft of the operating handle that is inserted through the hole of the bearing member and the operating handle. Therefore, the position of the operating handle with respect to the horizontal base can be fixed.

In accordance with the twentieth aspect of the present invention, an elastic member for transmitting a pressing force applied to the operating handle to the staple mounting magazine is provided between the operating handle and the staple mounting magazine. Thus, an energizing force in a downward direction from the operating handle to the staple mounting magazine arises by the spring member after the height of the operating handle relative to the horizontal base is fixed, enabling the staple mounting magazine to descend. Therefore, the paper bundle can be further pressed by the staple mounting magazine so that the paper bundle can be stapled reliably and neatly.

In accordance with the twenty-first aspect of the present invention, a fixed spring assisting in engagement with the support member is in contact with the key member to strengthen a force of the key member to engage with the support member. Therefore, the key member cannot descend or ascend from the predetermined position of the support member.

In accordance with the twenty-second aspect of the present invention, the key member includes a vertical portion and an engaging plate bent from the lower end portion of the vertical portion to have an insertion hole with which the support member can engage and is formed in an L cross-sectional shape, a key member housing portion in which the support member and the key member are housed is provided in the staple mounting magazine, and the bearing member supporting the key member is provided in the key member housing portion. Therefore, the key member is formed in the L cross-sectional shape, and thus the key member can be made to have an easy-to-mold and simple structure.

In accordance with the twenty-third aspect of the present invention, the elastic member is a spring member in a V-shape, and between the operating handle and the staple mounting magazine, one end of the spring member is attached to the operating handle and the other end of the spring member is attached to the staple mounting magazine. Thus, the staple mounting magazine can be made to have a reasonable and easy-to-form structure.

BRIEF DESCRIPTION OF THE DRAWINGS

FIG. 11A is a plan view, FIG. 11B is a side view, FIG. 11C is a back view, and FIG. 11D is a perspective view.

FIGS. 12A to 12C are structural views showing a horizontal base and a paper end guide according to the third embodiment, and FIG. 12A is a perspective view of the paper end guide, FIG. 12B is a perspective view of the horizontal base and FIG. 12C is a sectional view of along an A-A line in FIG. 12B.

FIG. 13A is a side view of the stapler and FIG. 13B is a side view of the paper end guide.

FIG. 15A is a plan view of a portion of the key member housing portion, FIG. 15B is a back view of a portion of the key member housing portion, FIG. 15C is a side view of the support member, and FIG. 15D is a back view of the support member shown in FIG. 15C.

FIG. 16A is a side view of the stapler when an outside board of the key member housing portion is removed and FIG. 16B is a partial enlarged view of FIG. 16A.

FIG. 17A is a side view of the stapler when the outside board of the key member housing portion is removed and FIG. 17B is a partial enlarged view of FIG. 17A.

FIG. 18A is a side view of the stapler when the outside board of the key member housing portion is removed and FIG. 18B is a partial enlarged view of FIG. 18A.

BEST MODE FOR CARRYING OUT THE INVENTION

First Embodiment of the Invention

A first embodiment of the present invention will be described below.

FIGS. 1 to 7 show the first embodiment of the present invention.

Figure 1:
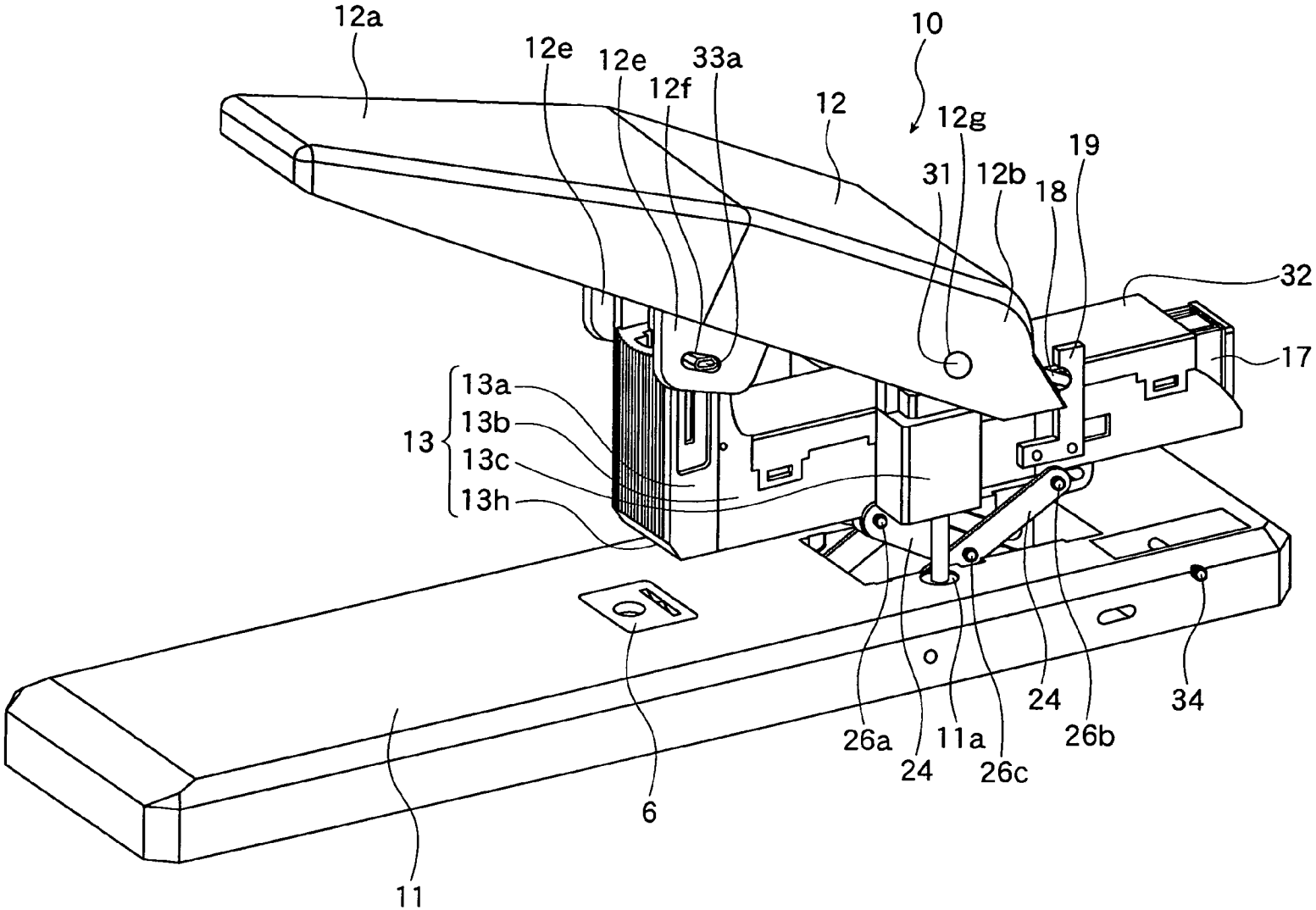
FIG. 1 is a perspective view of a stapler according to a first embodiment of the present invention.

As shown in FIG. 1, a stapler 10 includes a horizontal base 11 having an anvil 6 for bending a staple from lower ends, an operating handle 12 that has a pinching portion 12*e* pinching a supporter 33*a* of a fitting member 33*a* supporting a staple pushing blade 15 (See FIGS. 6 and 7) and can be pressed by hand, and a staple mounting magazine 13 in which staples are housed.

The operating handle 12 is provided with a handle spring 18 (See FIG. 6), which is a rotation direction elastic member, and the staple mounting magazine 13 is provided with a spring fastener 19 to which the handle spring 18 is engaged so that the handle spring 18 slides upward along a back side of the operating handle 12, and the operating handle 12 can rotate around a rotating shaft 31.

As shown in FIG. 1, the staple mounting magazine 13 is a member mounting a staple connecting assembly cassette 17 in which a staple connecting assembly connecting many staples is housed. The staple mounting magazine 13 is formed in an L shape as a side view and includes a blade guide portion 13*a* guiding the staple pushing blade 15 and a staple guide portion 13*b* through which the staple connecting assembly is moved in from right side in FIG. 1 and moved out by a pulley mechanism (not shown). The staple guide portion 13*b* of the staple mounting magazine 13 is covered with a magazine cover 32 from above.

Figure 2:
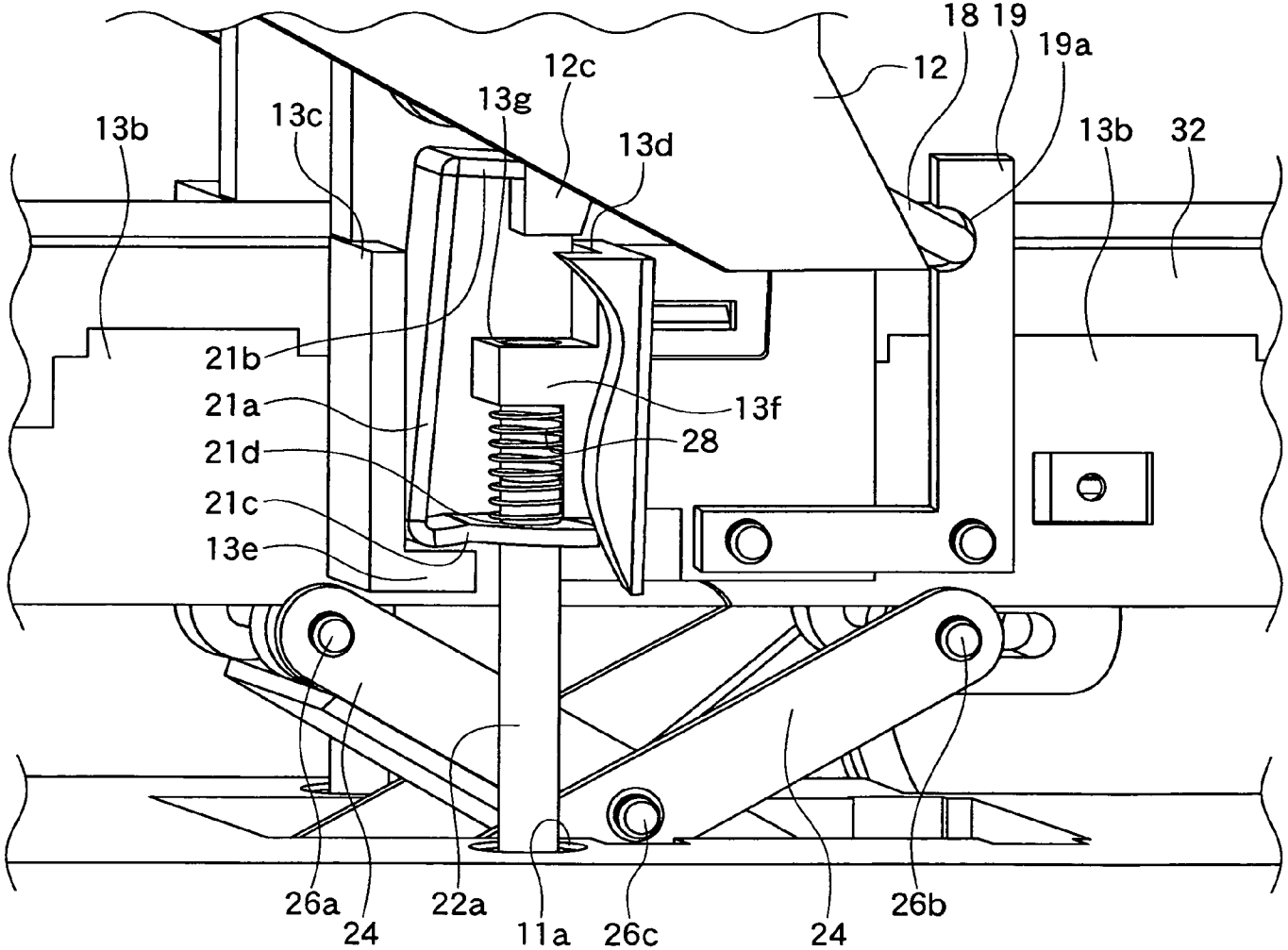
FIG. 2 is a structural view of the stapler showing positional relationships of a key member, a support member, and a fixed spring according to the first embodiment.

A key member housing portion 13*c* is provided approximately in a central portion on the side of the staple guide portion 13*b*, as shown in FIG. 1, and a through opening 13*d* is formed in the key member housing portion 13*c*, as shown in FIG. 2. Inside the through opening 13*d*, a closing plate 13*e* is formed at a lower opening so that the lower opening is more closed than an upper opening. A bearing portion 13*f* is also formed inside the through opening 13*d* approximately at a middle position between the upper opening and lower opening to shore up an upper round bar 22*a* of a support member 22.

Inside the through opening 13*d* of the key member housing portion 13*c*, a key member 21, which is a magazine vertical position fixing means for fixing the position of the staple mounting magazine 13, and the support member 22, which is the magazine vertical position fixing means, are disposed.

As shown in FIG. 2, the key member 21 includes a vertical portion 21*a*, a load receiving portion 21*b* bent from an upper end portion of the vertical portion 21*a* in a horizontal direction, and an engaging plate 21*c* bent from a lower end portion of the vertical portion 21*a* in the horizontal direction, and is formed approximately in a C-shape as a side view. An insertion hole 21*d* through which an upper portion of the upper round bar 22*a* of the support member 22 passes is formed in the engaging plate 21*c*.

Figure 5:
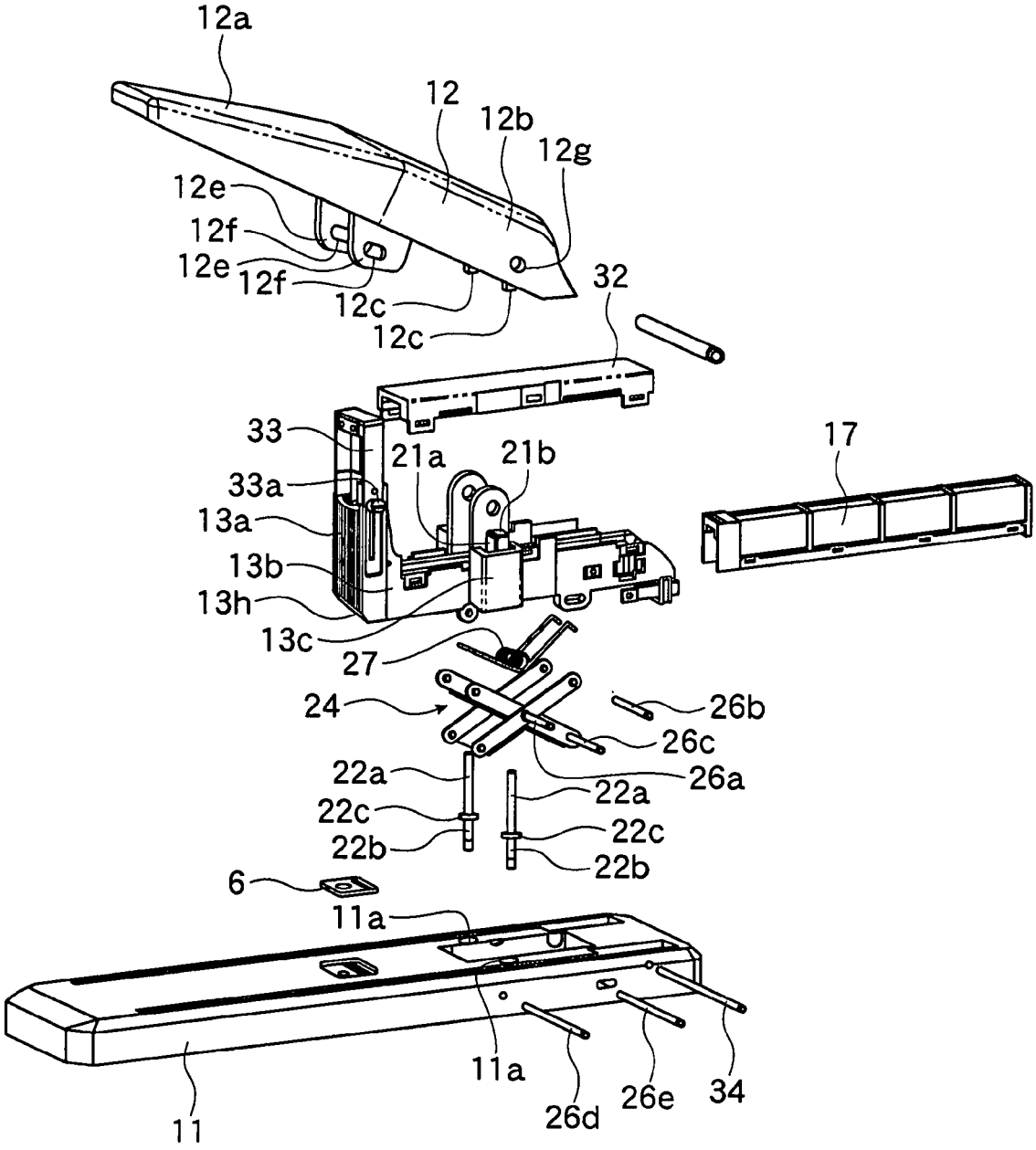
FIG. 5 is an exploded view of the stapler showing a pantograph spring according to the first embodiment.

As shown in FIG. 5, the support member 22 includes the upper round, bar 22*a*, a lower round bar 22*b*, and a flange 22*c* provided between the upper round bar 22*a* and lower round bar 22*c*, and the lower round bar 22*b* is fitted into a fixing hole 11*a* of the horizontal base 11 to be fixed.

As shown in FIG. 2, the upper round bar 22*a* of the support member 22 is inserted through the lower opening of the key member housing portion 13*c*, and the upper portion of the upper round bar 22*a* is fitted into the insertion hole 21*d* of the key member 21, then into a fixed spring 28 above, and into the bearing portion 13*f* further above.

Figure 3:
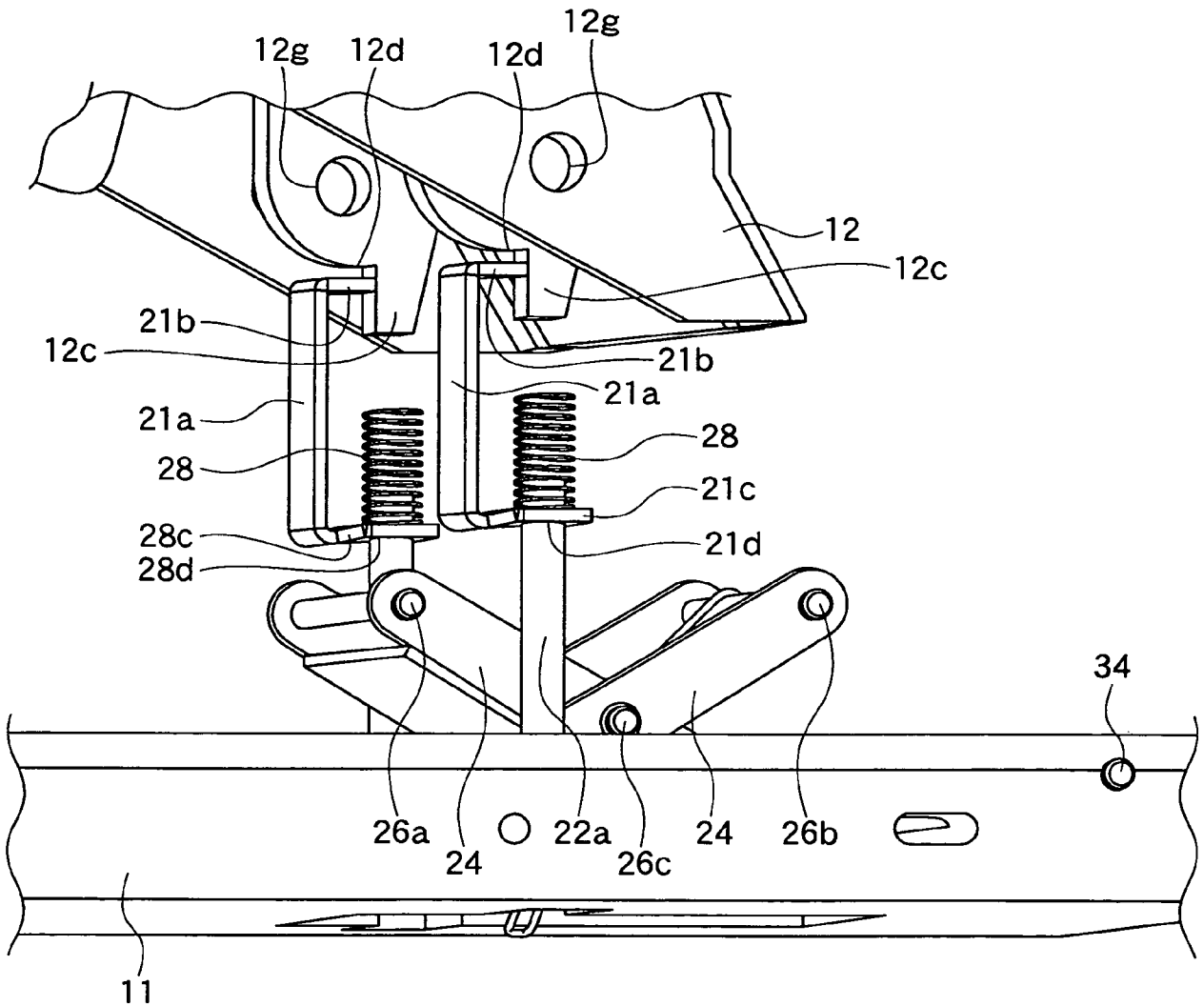
FIG. 3 is a structural view of the stapler showing positional relationships of a load transmission portion of an operating handle and a load supporting portion of the key member according to the first embodiment.
Figure 4:
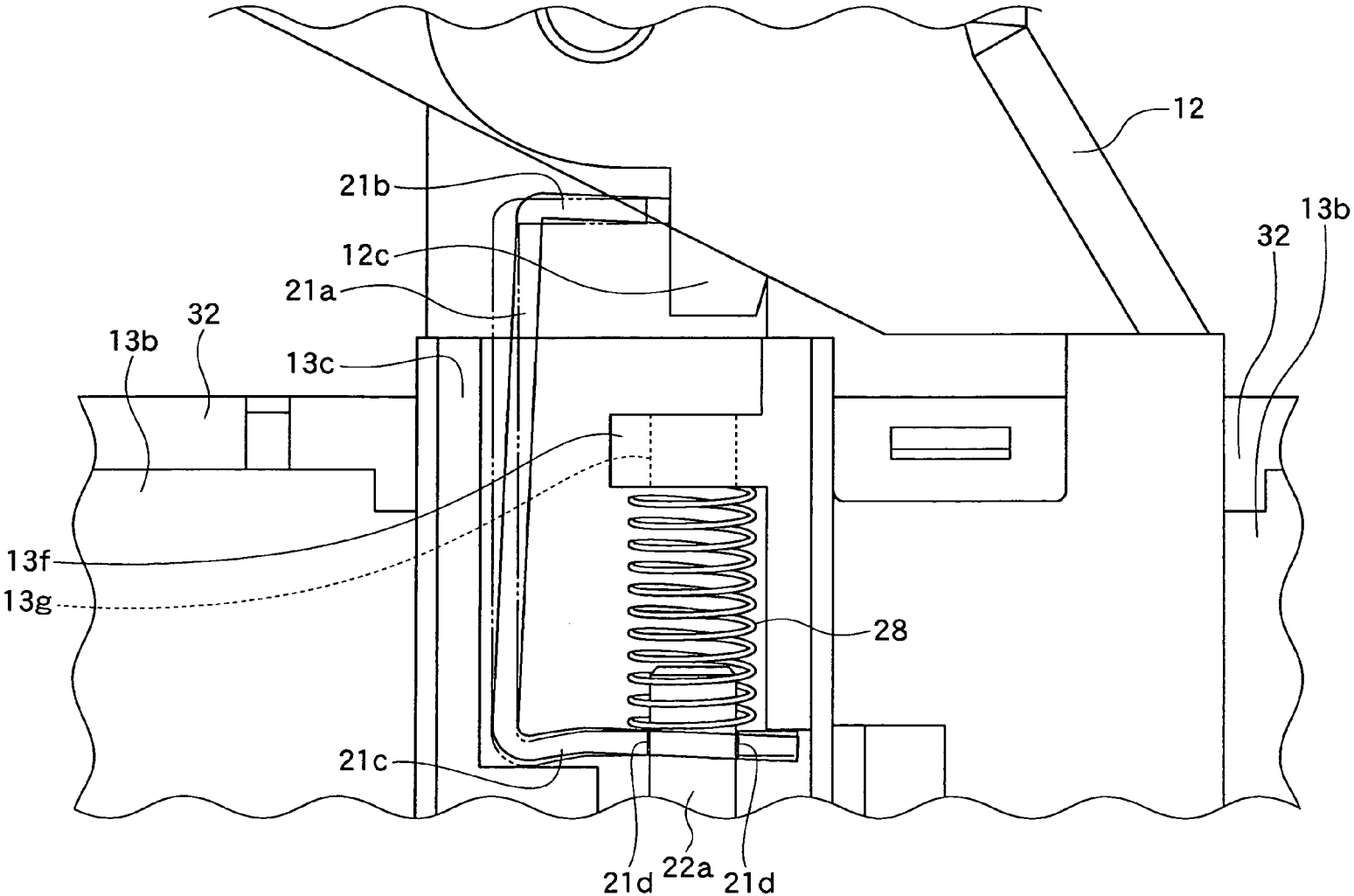
FIG. 4 is an enlarged structural view of FIG. 2 showing the positional relationships of the key member, support member, and fixed spring according to the first embodiment.

As shown in FIG. 3, the load receiving portion 21*b* is in contact with a load transmission portion 12*c* extended on the back side of the operating handle 12 before the operating handle 12 rotates around the rotating shaft 31 fitted into rotating shaft fitting holes 12*g*.

When the operating handle 12 rotates around the rotating shaft 31 after being pressed, the load transmission portion 12*c* rotates around the rotating shaft 13 to move in a backward direction of the stapler 10. Then, losing support by the load transmission portion 12*c*, the load receiving portion 21*b* of the key member 21 moves in the backward direction and is then tilted. Also, the fixed spring 28 attempts to expand against a compressive force between the bearing portion 13*f* and the engaging plate 21*c*. Then, a corner formed between the vertical portion 21*a* and the engaging plate 21*c* of the key member 21 comes into contact with the closing plate 13*e* and is pushed against the closing plate 13*e*. The key member 21 is tilted from a state of a chain double-dashed line to that of a solid line in FIG. 4 using a contact position as a fulcrum. As the staple mounting magazine 13 descends, the upper round bar 22*a* of the support member 22 runs through a guide hole 13*g* of the bearing portion 13*f*. By providing the key member 21 and support member 22 as described above, the position of the staple mounting magazine 13 is fixed by the insertion hole 21*d* being engaged with the support member 22 after the key member is tilted while the operating handle 12 rotates. Thus, if the operating handle 12 is pressed after a paper bundle is placed on the horizontal base 11, the staple mounting magazine 13 is brought into contact with a surface of the paper bundle and fixed to a position thereof.

If an operator's hand is taken off the operating handle 12 after the paper bundle is stapled, the operating handle 12 rotates around the rotating shaft 31 to return to a predetermined angle, and the load transmission portion 12*c* moves in a forward direction of the stapler 10. Then, by pushing out the load receiving portion 21*b* of the key member 21 in the horizontal direction, the vertical portion 21*a* of the key member 21 is lifted to return from the state of the solid line to that of the chain double-dashed line in FIG. 4 so that the vertical portion 21*a* becomes perpendicular to the horizontal base 11. An engagement state by the insertion hole 21*d* with the upper round bar 22*a* is released, and the upper round bar 22*a* can now move through the insertion hole 21*d*, and the operating handle 12 and staple mounting magazine 13 are lifted by an expansion force of a pantograph spring 27.

Figure 6:
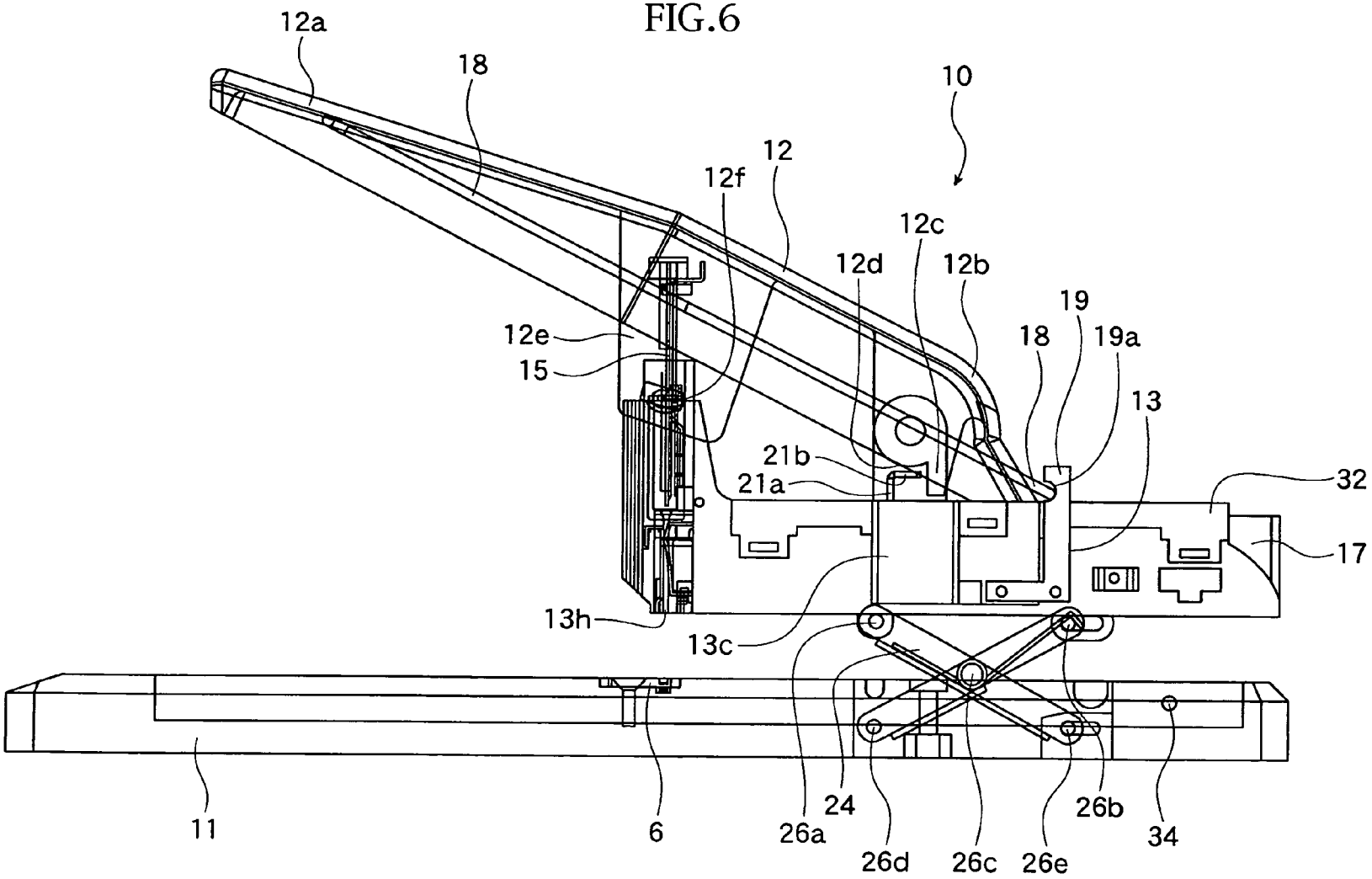
FIG. 6 is an end view of the stapler showing an arrangement of a blade according to the first embodiment.

As shown in FIGS. 1 and 6, the handle spring 18 is disposed on the back side of the operating handle 12, and a lower end side of the handle spring 18 is bent to be hooked on a receiving portion 19*a* formed on the spring fastener 19. When the operating handle 12 is rotated around the rotating shaft 31, the lower end side of the handle spring 18 is locked by the receiving portion 19*a*, and an upper end side of the handle spring 18 slides obliquely upward along the back side of the operating handle 12.

As shown in FIG. 5, a pattern arm 24, which is vertical movement means for causing movement in a vertical direction, is provided below the staple mounting magazine 13 and pivotally supported by a pattern shaft 26, and further the pantograph spring 27, which is a vertical direction elastic member to enable elastic vertical movement of the staple mounting magazine 13, is provided.

The handle spring 18, which is a rotation direction elastic member as post-vertical movement rotating means, is formed with more rigidity than the pantograph spring 27, which is a vertical direction elastic member as post-vertical movement rotating means. Thus, if the pantograph spring 27 elastically deforms and the staple mounting magazine 13 descends to come into contact with a paper bundle, descent of the staple mounting magazine 13 is stopped by the key member 21 being engaged with the support member 22 and the handle spring 18 elastically deforms.

Since the pantograph spring 27 undergoes a deformation before a deformation of the handle spring 18, the operating handle 12 can rotate around the rotating shaft 31 only after the staple mounting magazine 13 comes into contact with the paper bundle so that the staple mounting magazine 13 cannot descend further.

Figure 7:
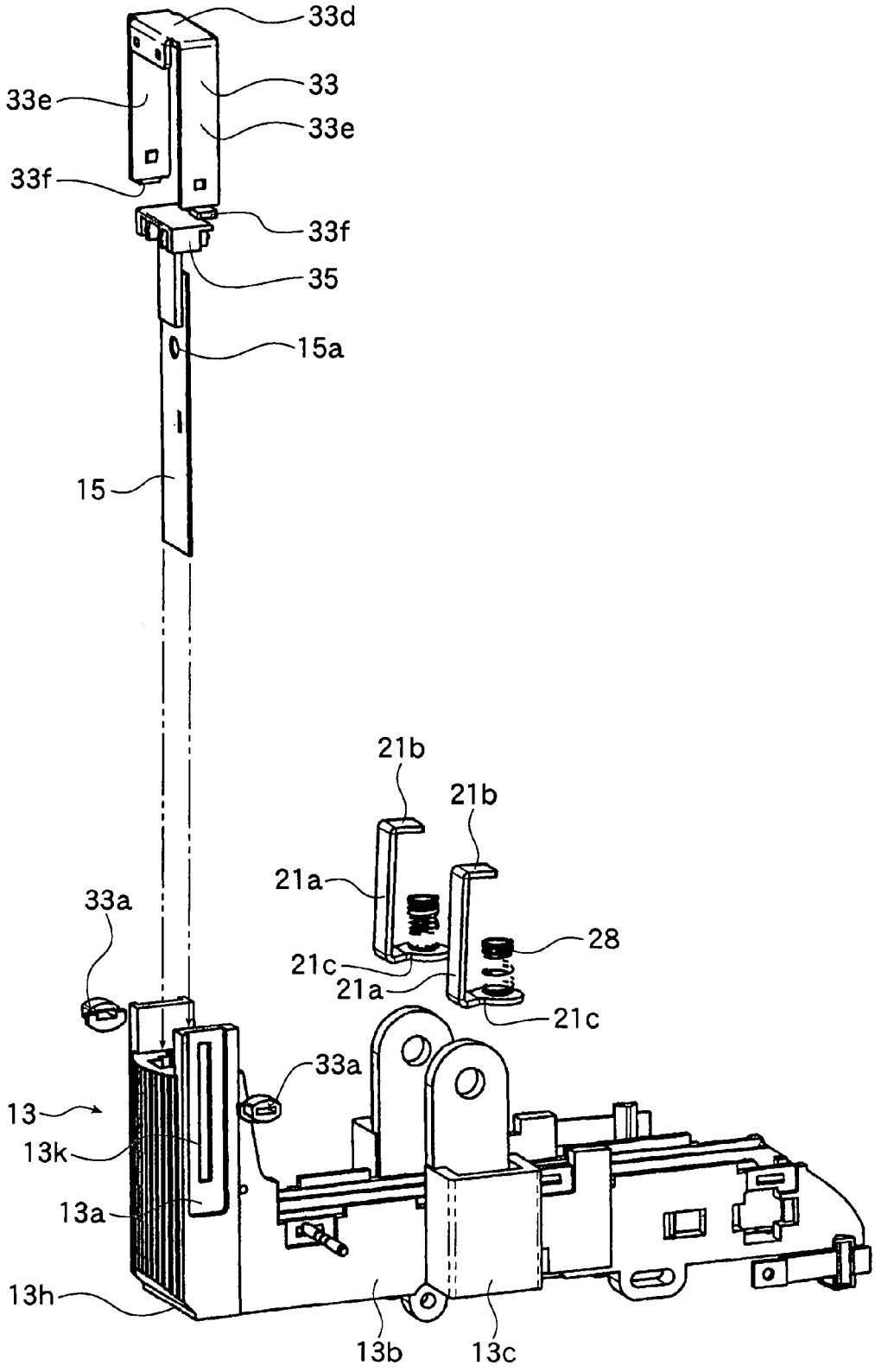
FIG. 7 is an exploded view of the stapler showing a configuration of the blade according to the first embodiment.

As shown in FIG. 7, the staple pushing blade 15 is held by a blade holder 35 and a blade pusher 33 is disposed above the blade holder 35. The blade pusher 33 is formed in a C shape, a pressing plate 33*d* in contact with the blade pusher 33 is formed in an upper portion thereof, a flank portion 33*e* moving vertically along the blade guide portion 13*a* is formed in a side portion thereof, and the lower end of the flank portion 33*e* is bent outward to form an insertion convex portion 33*f*, which is inserted through a guidance slotted hole 13*k* described later. The fitting member 33*a* is fitted into the insertion convex portion 33*f* while the insertion convex portion 33*f* is inserted through the guidance slotted hole 13*k*. Then, the fitting member 33*a* is fitted into a support hole 12*f* formed in the operating handle 12.

Therefore, the blade pusher 33 is made vertically movable along the blade guide portion 13*a* by vertical movement of the fitting member 33*a* along the guidance slotted hole 13*k*. Thus, if the fitting member 33*a* descends along the blade guide portion 13*a* when the operating handle 12 is rotated by pressing the operating handle 12, the upper end of the blade holder 35 is pressed by the blade pusher 33, the staple pushing blade 15 supported by the blade holder 35 will be caused to descend. At this point, the blade pusher 33 is rockable without support of the upper end portion thereof by the operating handle 12, and moves vertically while the insertion convex portion 33*f* formed at the lower end thereof is inserted through the guidance slotted hole 13*k* and fitted into the fitting member 33*a* formed in a hollow elliptic cylindrical shape and the fitting member 33*a* being supported by the support hole 12*f* of the operating handle 12. Since, as shown in FIG. 1, the support hole 12*f* has an elongated hole and hole edges are curved, the support hole 12*f* rotates around the fitting member 33*a* while keeping line contact with the fitting member 33*a* in a process of vertical movement of the fitting member 33*a* fitted into the insertion convex portion 33*f* along the guidance slotted hole 13*k*. Since the support hole 12*f* and fitting member 33*a* are in line contact described above, friction is harder to be generated between the support hole 12*f* and fitting member 33*a*, and thus the operating handle 12 can be rotated smoothly without feeling resistance.

Since descending positions of the blade holder 35 and staple pushing blade 15 are indirectly determined by the operating handle 12 when rotating the operating handle 12 by pressing, there is no need to make pins conventionally inserted into the upper end of the blade holder 35 movable along a receiving portion of pins provided on the back side of the operating handle 12.

If the blade pusher 33 ascends as the operating handle 12 ascends, a hooking portion formed in an actuator (not shown) provided in the blade pusher 33 is engaged with a blade hole 15*a* formed in the staple pushing blade 15 by the actuator to lift the staple pushing blade 15.

The height of position to support the staple pushing blade 15 is approximately the same as that of the rotating shaft 31 relative to the horizontal base 11. Since the staple pushing blade 15 is supported only at an approximately central position and the upper end portion thereof is not supported by the operating handle 12, no bending moment is applied between the approximate central position and upper end portion of the staple pushing blade 15, and thus a large lateral component of force does not arise when the staple pushing blade 15 moves.

When the staple pushing blade 15 descends, staples are brought down toward the horizontal base 11 to be discharged from a staple discharge port 13*h* provided at the lower end portion of the blade guide portion 13*a*.

Next, operations of the stapler 10 in the first embodiment of the present invention will be described.

First, a paper bundle is placed on the horizontal base 11, and a handle tip portion 12*a* of the operating handle 12 is pressed. Then, the pantograph spring 27 is compressed, and while the upper round bar 22*a* of the support member 22 passes through the guide hole 13*g* formed in the bearing portion 13*f*, the staple mounting magazine 13 descends. When the staple mounting magazine 13 comes into contact with the paper bundle, since the pantograph spring 27 cannot be bent still further, rotation of the operating handle 12 is started and the load transmission portion 12*c* is moved in the backward direction. Then, when the fixed spring 28 expands against a compressive force, the vertical portion 21*a* of the key member 21 is tilted, and the insertion hole 21*d* of the key member 21 is engaged with a flank of the support member 22 to fix the position of the staple mounting magazine 13.

Then, if the operating handle 12 is further pressed down, the fitting member 33*a* pinched by the support holes 12*f* is caused to descend to bring down the staple pushing blade 15 and to push a staple perpendicularly to the paper bundle, and the paper bundle is stapled.

According to the stapler 10 described above, the pantograph 24 that causes the operating handle 12 to vertically descend together with the staple mounting magazine 13 by pressing the operating handle 12 while keeping the handle at a predetermined angle and the handle spring 18 and pantograph spring 27 that can start rotation of the operating handle 12 when the staple mounting magazine 13 vertically descends to come into contact with a paper bundle placed on the horizontal base 11 are provided. Thus, a staple, after being guided to a vicinity of the surface of the paper bundle while mounted in the staple mounting magazine 13, is pushed into the surface of the paper bundle by rotating the operating handle 12. Therefore, the paper bundle is not stapled obliquely and irregularities of the stapled paper bundle can be prevented.

Also, the key member 21 and support member 22 to fix the vertical position of the staple mounting magazine 13 after the operating handle 12 starts rotation are provided. Thus, after being felt that the staple mounting magazine 13 has been brought into contact with the surface of the paper bundle, the staple can be pushed into the paper bundle by rotating the operating handle 12. Therefore, a timing when a staple should be pushed into the paper bundle becomes easier to understand.

Further, the pantograph 24 to cause the staple mounting magazine 13 to descend and ascend on the horizontal base 11 is provided. Thus, the staple mounting magazine 13 is caused to descend and ascend while keeping a parallel state with the horizontal base 11 by operating a mechanism of the pantograph 24. Therefore, a structure of descent and ascent of the staple mounting magazine 13 can be simplified.

Also, the pantograph spring 27 to support the staple mounting magazine 13 and the handle spring 18 to rotate the operating handle 12 are provided. Thus, after the pantograph spring 27 elastically deforms and the operating handle 12 descends together with the staple mounting magazine 13 by keeping a predetermined angle to come into contact with a paper bundle, the handle spring 18 elastically deforms to start rotation of the operating handle 12. Therefore, it becomes possible to cause a staple to descend vertically before the staple comes into contact with the paper bundle and then to push the staple into the surface of the paper bundle so that the paper bundle can be stapled vertically.

Further, the support member 22 set up on the horizontal base 11 for guiding vertical movement of the staple mounting magazine 13, key member 21 movable along the support member 22, and key member 21 are provided. Thus, the staple mounting magazine 13 can descend and ascend while the key member 21 is not engaged with a flank of the support member 22, and the position of the staple mounting magazine 13 in the vertical direction is fixed while the key member 21 is engaged with the flank of the support member 22. Therefore, the key member 21 can stop movement of the support member 22 at any position in the vertical direction to fix the position so that the staple mounting magazine 13 can be fixed at an appropriate height in accordance with thickness of the paper bundle.

Moreover, the fixed spring 28 to assist the key member 21 in engagement with the support member 22 is in contact with the key member 21 to strengthen an engagement force of the key member 21 with the support member 22. Therefore, the key member 21 cannot ascend from a predetermined position of the support member 22.

Also, the key member 21 includes the vertical portion 21*a*, the load receiving portion 21*b* receiving a load of the operating handle by bending at the upper end portion of the vertical portion 21*a*, and the engaging plate 21.*c* having the insertion hole 21*d* with which the support member 22 can be engaged by bending at the lower end portion of the vertical portion 21*a*, and is formed in a C cross-sectional shape. Thus, a structure for causing the key member 21 to engage with the support member 22 becomes simpler and molding is easy.

Further, the fixed spring 28 is disposed by applying a compressive force between the bearing portion 13*f* of the support member 22 formed in the key member housing portion 13*c* housing the key member 21 and support member 22 provided in the staple mounting magazine 13 and the engaging plate 21*c*. Thus, when the fixed spring 28 expands, the key member 21 is tilted and the insertion hole 21*d* is engaged with the flank of the upper round bar 22*a* so that the staple mounting magazine 13 can be fixed.

Also, the load transmission portion 12*c* to transmit a load on the operating handle 12 to the key member 21 is formed on the back side of the operating handle 12, and the load receiving portion 21*b* and the load transmission portion 12*c* are provided face to face with each other. Thus, when the operating handle 12 is rotated, the load transmission portion 12*c* moves away from the load receiving portion 21*b*, the engaging plate 21*c* and support member 22 engage with each other, and movement of the key member 21 with respect to the support member 22 is stopped. When the operating handle 12 is not rotated, the load transmission portion 12*c* is pushed against the load receiving portion 21*b* to release engagement between the engaging plate 21*c* and support member 22, and the key member 21 can move with respect to the support member 22. Therefore, when rotation of the operating handle 12 is started, the staple mounting magazine 13 is positioned and when the operating handle 12 does not rotate, the staple mounting magazine 13 can descend and ascend.

Further, the blade pusher 33 pressing the staple pushing blade 15 to descend is rockable without support of the upper end portion thereof by the operating handle 12, and the fitting member 33*a* fitted into the insertion convex portion 33*f* formed at the lower end portion thereof is supported by the operating handle 12. Thus, the bending moment applied to the staple pushing blade 15 does not grow large when the operating handle 12 is rotated like a conventional type moving the upper end of the staple pushing blade 15 along the back side of the operating handle 12. Therefore, disengage of the staple pushing blade 15 from the operating handle 12 and wear of the staple pushing blade 15 can be prevented unlike a conventional type in which the upper end of the staple pushing blade 15 is moved along the back side of the operating handle 12.

Moreover, the insertion convex portion 33*f* formed on the blade pusher 33 is inserted through the guidance slotted hole 13*k* formed inside the blade guide portion 13*a* of the staple mounting magazine 13 and fitted into the fitting member 33*a*, and the support hole 12*f* to support the fitting member 33*a* is formed in the staple mounting magazine 13 so that the operating handle 12 rotates while the fitting member 33*a* and support hole 12*f* are in line contact. Thus, if the operating handle 12 is rotated, the support hole 12*f* rotates around the fitting member 33*a* while in line contact with the fitting member 33*a*. Therefore, a contact surface between the support hole 12*f* and fitting member 33*a* is minimum and friction becomes smaller, and thus the operating handle 12 rotates easily to allow improvement of operability of the operating handle 12.

Also, the position of a midway point between the upper end and lower end of positions where the insertion convex portion 33*f* and fitting member 33*a* move before and after descent/ascent by an operation of the operating handle 12 is approximately as high as the rotating shaft 31 of the operating handle 12. Thus, the moving direction of a portion of the staple pushing blade 15 where the staple pushing blade 15 is supported is directed in the vertical direction when the operating handle 12 is rotated in comparison with a case in which the upper end portion of the staple pushing blade 15 is supported. Therefore, the lateral component of force that arises when the staple pushing blade 15 is brought down becomes smaller in comparison with the case in which the upper end portion of the staple pushing blade 15 is supported, allowing to make a load on the staple pushing blade 15 smaller.

The insertion convex portion 33*f* is formed at the lower end of the blade pusher 33 in the first embodiment of the present invention, but the present invention is not limited to the above embodiment, and the insertion convex portion 33*f* may be formed at any location other than the upper end portion of the blade pusher 33.

The support hole 12*f* is a slotted hole combining straight lines and arcs and the fitting member 33*a* has an elliptic shape in the first embodiment of the present invention, but the present invention is not limited to the embodiment as long as rotation of the operating handle 12 can be made smooth. That is, the support hole 12*f* can have an elliptic shape and the fitting member 33*a* can have a slotted hole combining straight lines and arcs. In any case, the support hole 12*f* and fitting member 33*a* must be made to line-contact.

The fitting member 33*a* has an elliptic shape in the first embodiment of the present invention, but the fitting member 33*a* can also be formed into a spherical shape in order to make rotation of the operating handle 12 still smoother. That is, by providing the fitting member 33*a* in a spherical shape and the support hole 12*f* in a slotted hole combining straight lines and arcs described above, the fitting member 33*a* and support hole 12*f* will come into point contact, making a contact range still smaller and harder for friction to arise.

Further, it is possible not only to form the fitting member 33*a* in a spherical shape as described above, but also to form the support hole 12*f* in a curved shape like an elliptic shape to make the fitting member 33*a* and support hole 12*f* to come into point contact.

By making the fitting member 33*a* and support hole 12*f* come into line contact rather than surface contact, and point contact rather than line contact as described above, it becomes harder for friction to arise between the fitting member 33*a* and support hole 12*f* to improve operability by rotation of the operating handle 12.

Second Embodiment of the Invention

A second embodiment of the present invention is different from the first embodiment of the present invention in that handle springs 41 and 42, which are rotation-direction elastic members for connecting the horizontal base 11 and operating handle 12, are used without using the handle spring 18.

Figure 8:
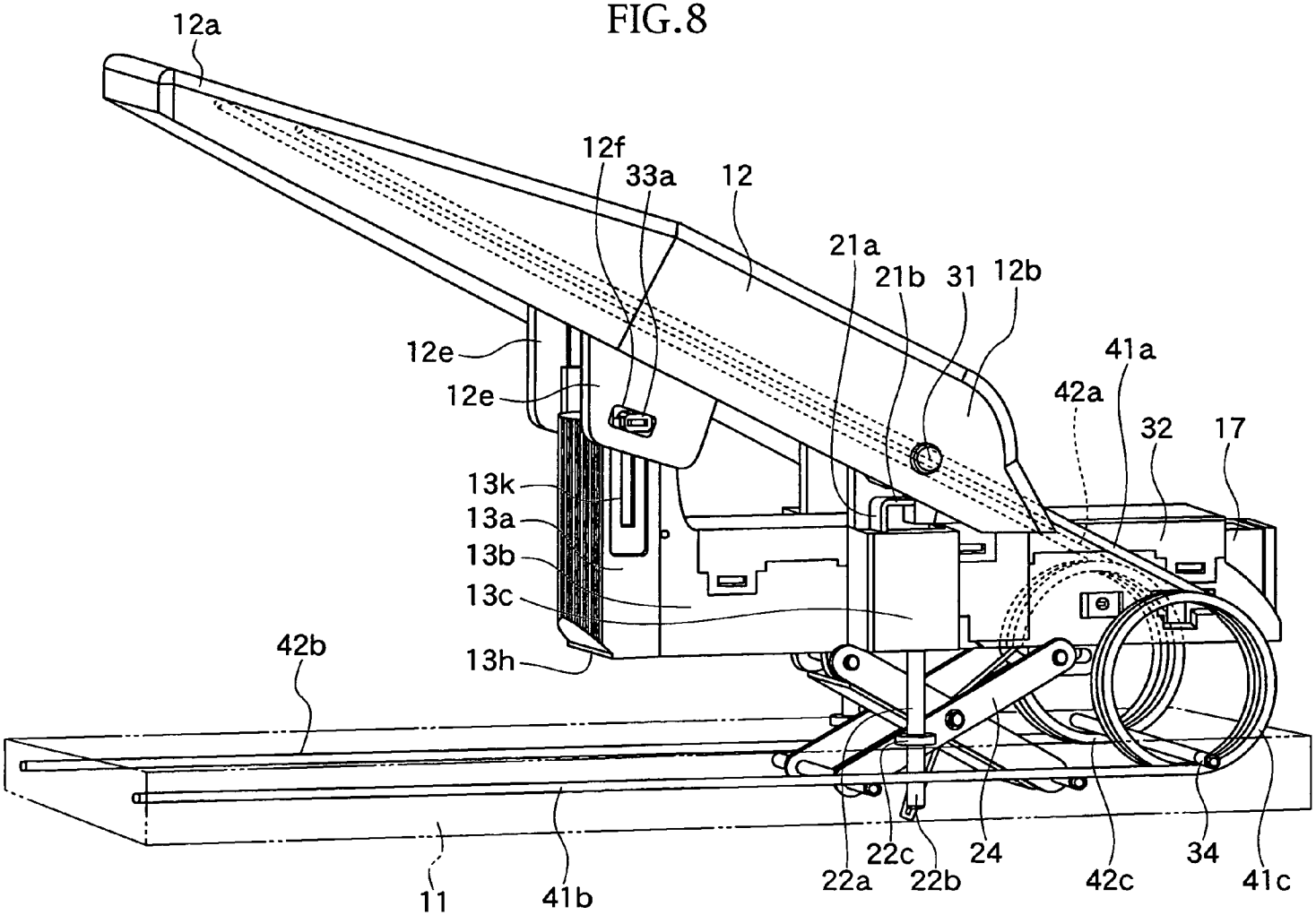
FIG. 8 is a perspective view of a stapler according to a second embodiment of the present invention.

In FIG. 8, the same reference numerals are used for the same members as those in the first embodiment and a stapler in FIG. 8 shall be a stapler 40 in the second embodiment of the present invention.

As shown in FIG. 8, the handle springs 41 and 42 have handle-side linear portions 41*a* and 42*a* and base-side linear portions 41*b* and 42*b*, and twist portions 41*c* and 42*c* between the handle-side linear portions 41*a* and 42*a* and the base-side linear portions 41*b* and 42*b*. The handle-side linear portions 41*a* and 42*a* are fixed to the back side of the operating handle 12 and the base-side linear portions 41*b* and 42*b* are fixed onto the horizontal base 12. The operating handle 12 has the handle tip portion 12*a* and a handle base end 12*b* and, if the handle tip portion 12*a* is pressed by hand, the operating handle 12 will rotate around the rotating shaft 31 with the twist portions 41*c* and 42*c* acting as approximate centers and the handle tip portion 12*a* will be pushed toward the horizontal base 11.

Also with the stapler 40 described above, a staple can be pushed into a paper bundle when the staple mounting magazine 13 is caused to descend by the pantograph spring 27 and then the operating handle 12 is caused to rotate around the twist portions 41*c* and 42*c* by the handle springs 41 and 42.

Third Embodiment of the Invention

A third embodiment of the present invention will be described below. FIGS. 9 to 12 show the third embodiment of the present invention.

Figure 9:
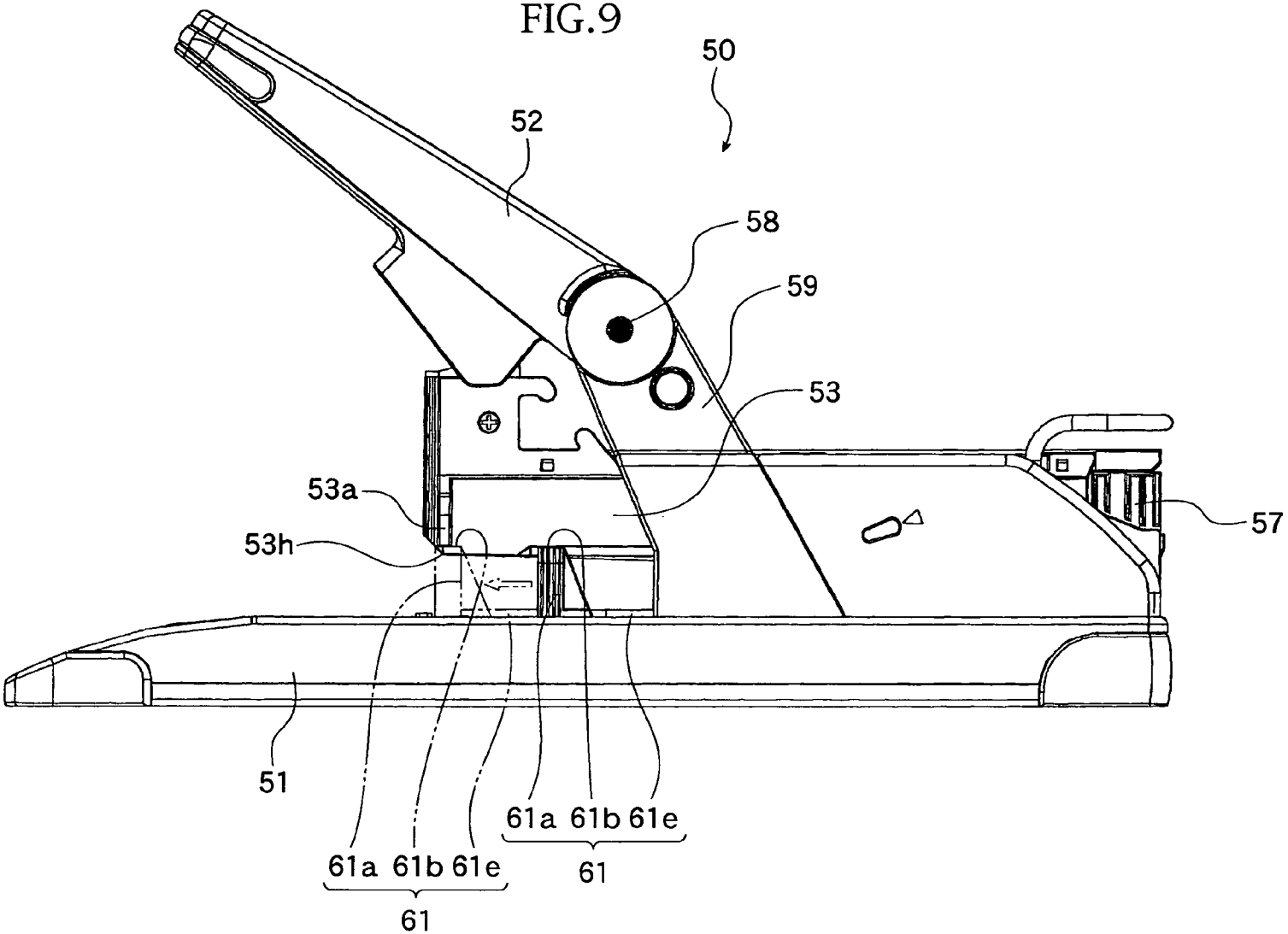
FIG. 9 is a side view of a stapler according to a third embodiment of the present invention.
Figure 10:
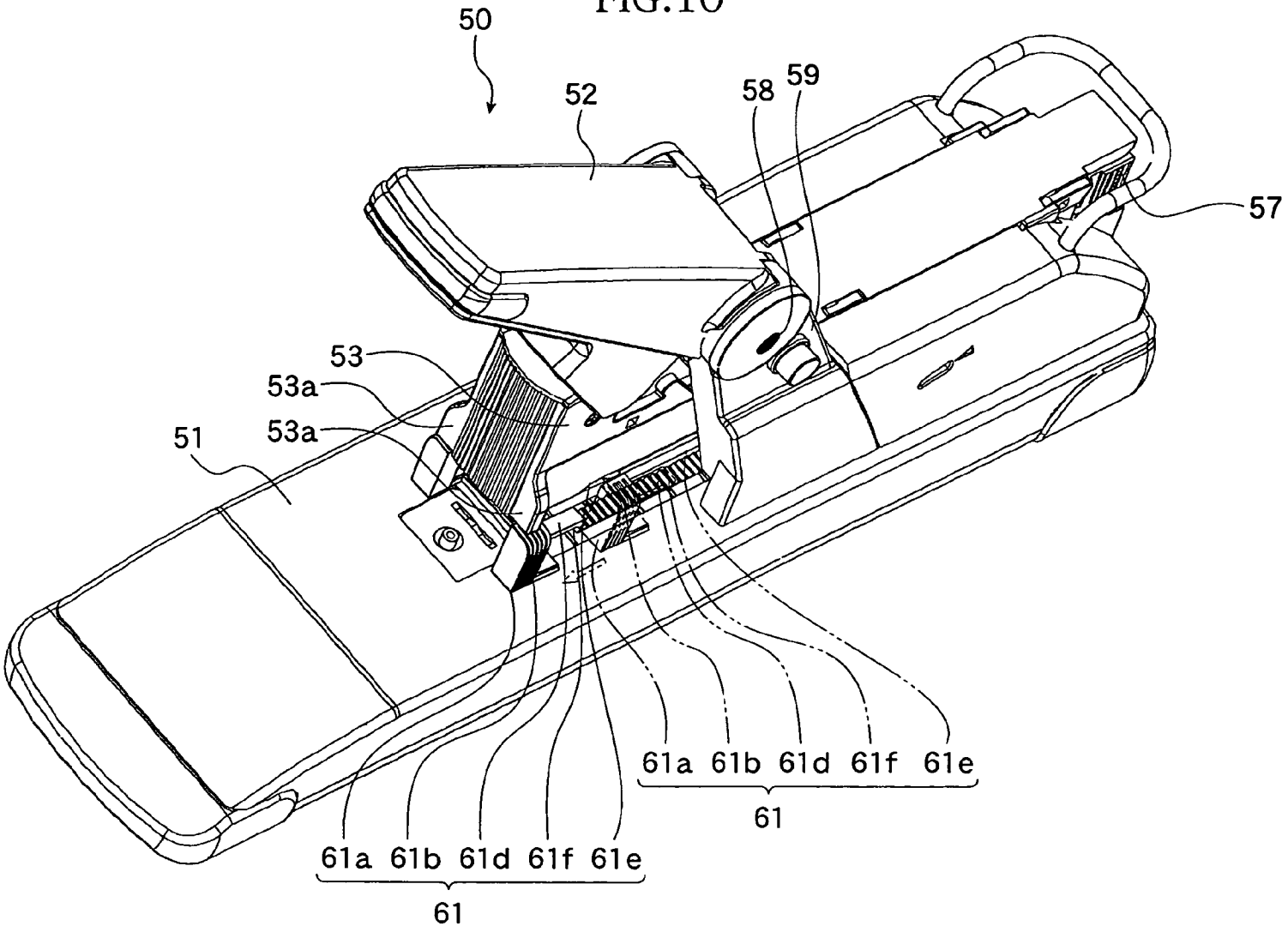
FIG. 10 is a perspective view of a stapler according to the third embodiment.
Figure 11A:
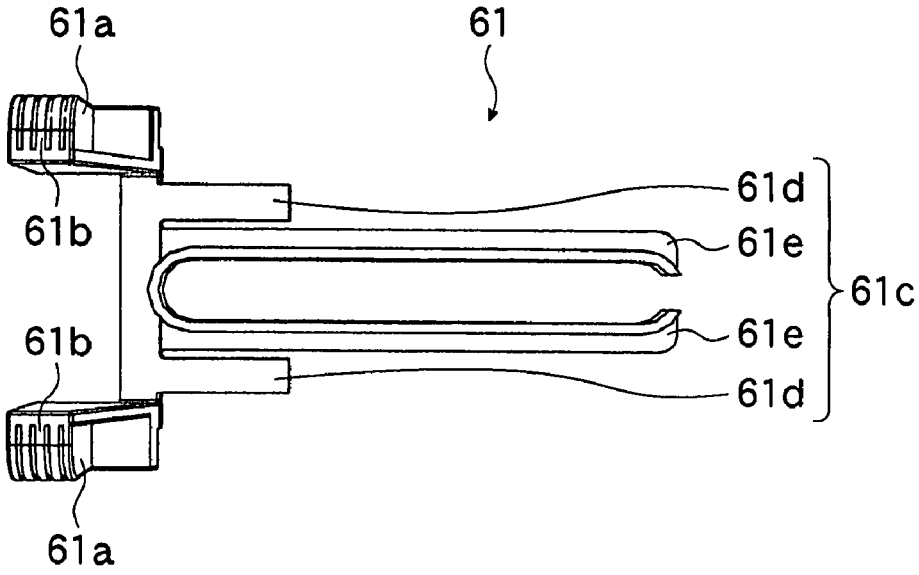
FIGS. 11A to 11D show paper end guides according to the third embodiment.
Figure 11B:
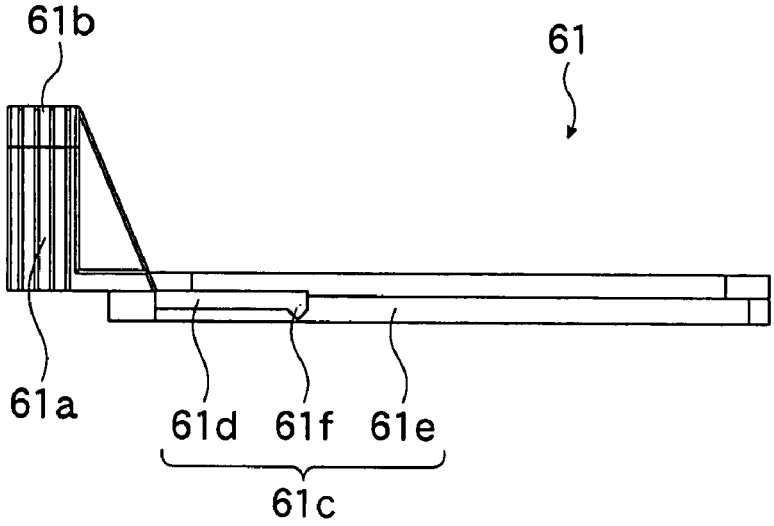
Figure 11C:
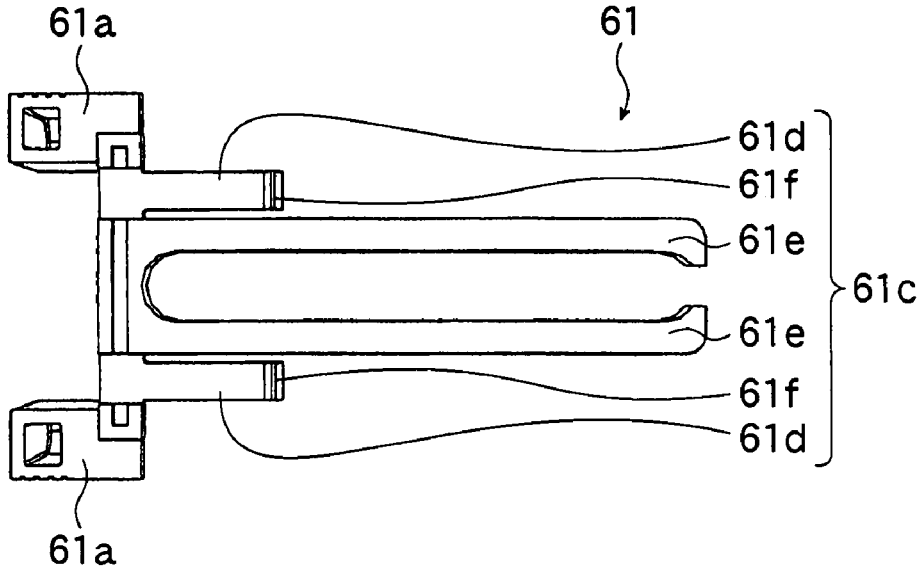
Figure 11D:
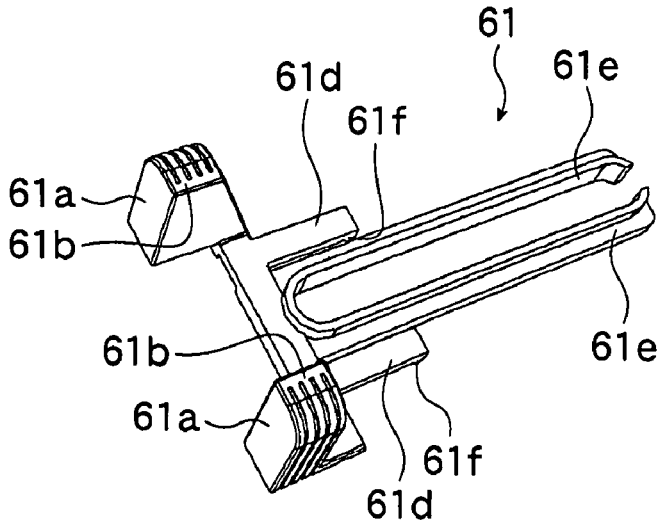

As shown in FIGS. 9 and 10, a stapler 50 includes a horizontal base 51, an operating handle 52 arranged at a predetermined angle with respect to the horizontal base 51, a staple mounting magazine 53 attached to the operating handle 52 to mount a staple connecting assembly cassette 57 in which a staple connecting assembly connecting many staples is housed, and a staple pushing blade (not shown) brought down on a staple housed in the staple mounting magazine 53. The operating handle 52 is freely rotatably connected to a case 59 provided on the horizontal base 51 and can rotate around a lever rotating shaft 58, which is a connecting position. Then, the staple mounting magazine 53 is pinched and housed in the case 59. A paper end guide 61 formed like in an L shape as a side view is disposed on the horizontal base 51.

As shown in FIGS. 11A to 11D of the paper end guide 61 includes a horizontal portion 61*c* moving on the horizontal base 51 and a vertical portion 61*a* supporting the staple mounting magazine 53. The paper end guide 61 is provided to adjust a stapling position of a paper bundle and also to push staples on a trial basis. An engaging claw 61*f* that can be engaged with engaged concave portions 51*d* (See FIGS. 12A to 12C) of the horizontal base 51 described later is formed on the paper end guide 61.

As shown in FIGS. 9 and 10, on the other hand, convex portions 53*a* are formed in a portion of the staple mounting magazine 53. The convex portions 53*a* are formed near a staple discharge port 53*h* of the staple mounting magazine 53. Then, staples can be pushed on a trial basis by bringing an upper end 61*b* of a vertical portion 61*a* into contact with a lower end of the convex portions 53*a*.

As shown in FIGS. 12A to 12C, a guide concave portion 51*a* is also formed on the horizontal base 51 and a guide rail portion 51*b* having a plurality of engaged convex portions 51*c* and a plurality of engaged concave portions 51*d* is provided in the guide concave portion 51*a* along a longitudinal direction of the horizontal base 51.

Next, operations of the stapler 50 in the third embodiment of the present invention will be described.

When an operator staples a paper bundle using the stapler 50, the vertical portion 61*a* of the paper end guide 61 is arranged apart from the convex portions 53*a*, as shown by a solid line shown in FIG. 9, and when the operator wants to push staples on a trial basis, the vertical portion 61*a* of the paper end guide 61 is caused to move to below the convex portions 53*a*, as shown by a chain double-dashed line in FIG. 9.

As shown in FIG. 10, in order to move the paper end guide 61 as described above, the engaging claw 61*f* (See FIGS. 11A to 11D) of the paper end guide 61 is removed from the engaged concave portions 51*d* (See FIGS. 12B and 12C provided on the horizontal base 51, and a guide framework 61*e* is moved to below the convex portions 53*a* to cause the engaging claw 61*f* to engage with the engaged concave portion 51*d* at the position.

Then, if the operator applies a force to the operating handle 52, the operating handle 52 rotates around the lever rotating shaft 58, and the convex portions 53*a* of the staple mounting magazine 53 come into contact with the upper end 61*b* of the vertical portion 61*a* of the paper end guide 61. By further rotating the operating handle 52, the staple pushing blade (not shown) inside the staple mounting magazine 53 is brought down to discharge a staple from the staple discharge port 53*h* to complete pushing staples on a trial basis.

In order to staple a paper bundle in a normal manner again, the paper end guide 61 is caused to move in a direction opposite to an arrow in FIG. 9 or 10 to arrange the vertical portion 61*a* of the paper end guide 61 in a position apart from below the convex portions 53*a* before the engaging claw 61*f* is caused to engage with the engaged concave portion 51*d*.

If, in this state, the operator rotates the operating handle 52 around the lever rotating shaft 58, the staple mounting magazine 53 comes in between two vertical portions 61*a* provided in the paper end guide 61 so that the staple mounting magazine 53 can be caused to descend onto the horizontal base 51 to staple a paper bundle.

According to the stapler 50 described above, the paper end guide 61 including the horizontal portion 61*c* moving on the horizontal base 51 and the vertical portion 61*a* supporting the staple mounting magazine 53 and formed in an L shape as a side view to adjust the stapling position of a paper bundle through the vertical portion 61*a*, and the convex portions 53*a* formed in a portion of the staple mounting magazine 53 are provided. Thus, by moving the vertical portion 61*a* on the horizontal base 51 to below the convex portions 53*a* of the staple mounting magazine 53, being blocked by the vertical portion 61*a* of the paper end guide 61, the staple mounting magazine 53 can be made not to descend up to the horizontal base 51 even if the operating handle 52 is rotated. Therefore, staples can be pushed on a trial basis even if there is no paper bundle between the staple mounting magazine 53 and horizontal base 51.

Also, the convex portions 53*a* of the staple mounting magazine 53 are formed near the staple discharge port 53*h* of the staple mounting magazine 53. Thus, if the vertical portion 61*a* of the paper end guide 61 is caused to move to a vicinity of the staple discharge port 53*h*, the convex portions 53*a* of the staple mounting magazine 53 and the vertical portion 61*a* of the paper end guide 61 can come into contact as the staple mounting magazine 53 descends. Therefore, if the operator of the stapler 50 brings the vertical portion 61*a* of the paper end guide 61 closer to the staple discharge port 53*h*, it can easily be recognized that staples can be pushed on a trial basis, instead of being enable to normally push staples.

Further, the guide rail portion 51*b* guiding the paper end guide 61 having a plurality of engaged concave portions 51*d* along the longitudinal direction of the horizontal base 51 is provided in the horizontal base 51, and the engaging claw 61*f* that can be engaged with the engaged concave portions 51*d* are formed on the paper end guide 51. Thus, when pushing staples on a trial basis, the engaging claw 61*f* of the paper end guide 61 is engaged with the engaged concave portions 51*d* provided in the guide rail portion 51*b* on the horizontal base 51 so that the paper end guide 61 can reliably be fixed onto the horizontal base 51. Therefore, there is no possibility of the paper end guide being moved when setting a paper bundle to the stapler in order to make paper edges of the paper bundle to be stapled aligned. If the staple mounting magazine 53 is caused to descend to push staples on a trial basis, the paper end guide 61 will not move on the horizontal base 51 and staples can reliably be pushed on a trial basis without causing arrangement shifts between the vertical portion 61*a* of the paper end guide 61 and the convex portions 53*a* of the staple mounting magazine 53.

Materials of the paper end guide 61 and the horizontal base 51 are not specified in the third embodiment of the present invention, but the present invention is not limited to the above embodiment. That is, it is possible to adopt a configuration in which magnets are provided on the back side of the paper end guide 61 and an upper surface of the horizontal base 51 is formed of an iron plate to which a magnet is attached. For example, magnets are provided on the back side of the horizontal portion 61*c* of the paper end guide 61 excluding an area of an engaging hook plate 61*d* and an area between rails of the guide rail portion 51*b* on the upper surface of the horizontal base 51 is formed from an iron plate.

Since the paper end guide 61 provided with magnets can be attached to and detached from the area between rails of the guide rail portion 51*b* formed of an iron plate, the paper end guide 61 can reliably be fixed at a location on the horizontal base 51 to which the paper end guide 61 should be moved and also the paper end guide 61 can be easily moved on the horizontal base 51.

Fourth Embodiment of the Invention

Figure 13A:
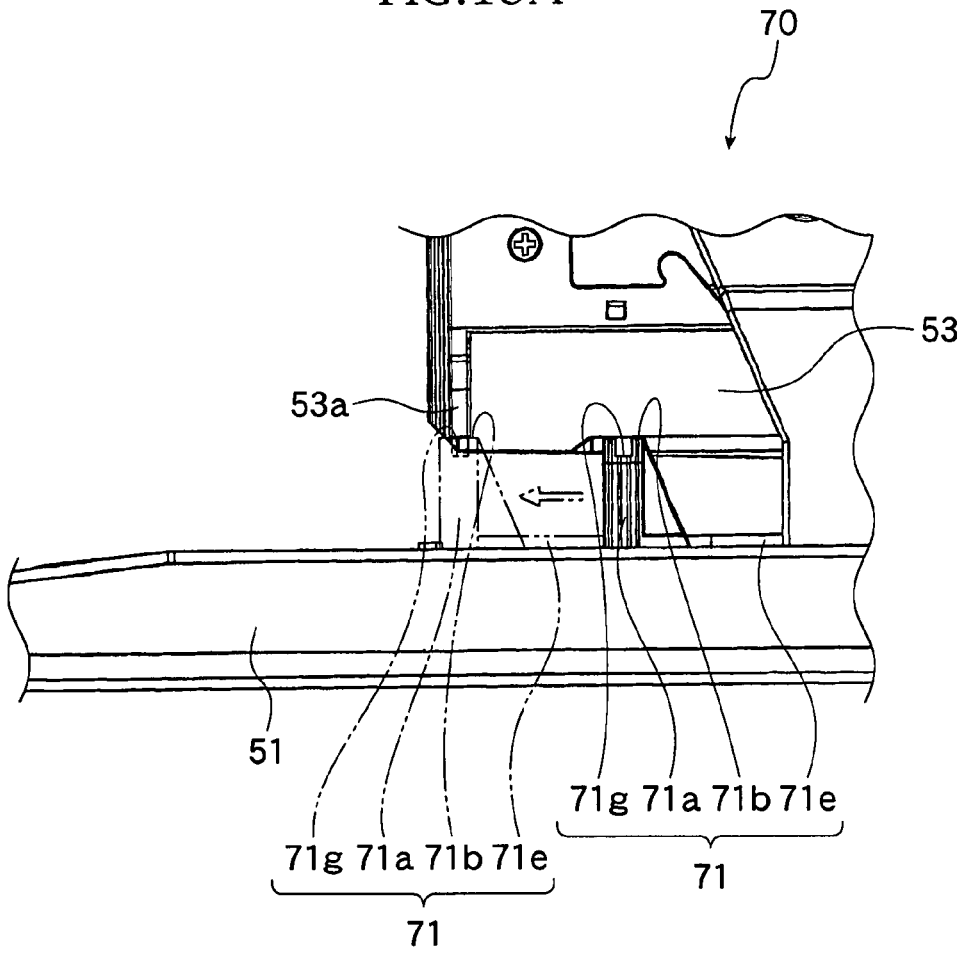
FIGS. 13A to 13B show staplers and paper end guides according to a fourth embodiment of the present invention.
Figure 13B:
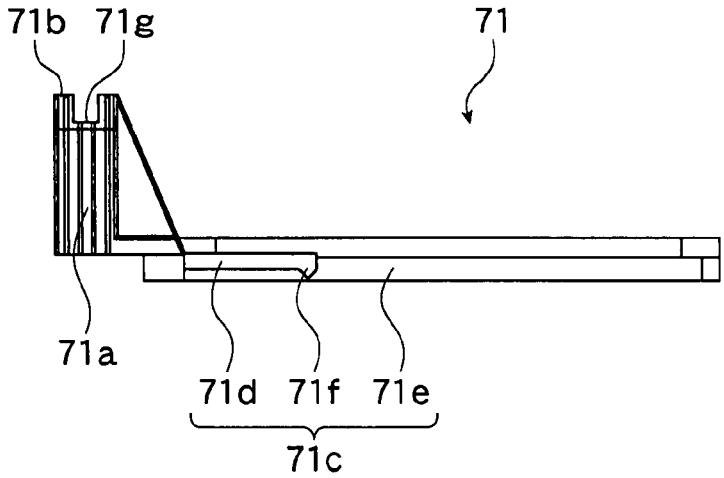

A fourth embodiment of the present invention will be described below. The fourth embodiment of the present invention is shown in FIGS. 13A and 13B.

A stapler 70 in the fourth embodiment of the present invention is different from the stapler 50 in the third embodiment of the present invention in that a paper end guide 71 is used instead of the paper end guide 61. That is, as shown in FIG. 13B, a shift preventive concave portion 71*g* is formed at an upper end 71*b* of a vertical portion 71*a* in the paper end guide 71. For other components, the same reference numerals are attached to the same components as those in the third embodiment and a description thereof is not repeated.

Next, operations of the stapler 70 in the fourth embodiment of the present invention will be described.

When an operator staples a paper bundle using the stapler 70, the vertical portion 71*a* of the paper end guide 71 is arranged apart from the convex portions 53*a*, as shown by a solid line shown in FIG. 13A, and when the operator wants to push staples on a trial basis, the vertical portion 71*a* of the paper end guide 71 is caused to move to below the convex portions 53*a*, as shown by a chain double-dashed line in FIG. 13A.

An engaging claw 71*f* of the paper end guide 71 is removed from the engaged concave portions 51*d* provided on the horizontal base 51 to move the paper end guide 71 so that the upper end 71*b* of the vertical portion 71*a* moves to a position below the convex portions 53*a* to engage the engaging claw 71*f* with the engaged concave portions 51*d* at the position.

Then, the operator rotates the operating handle 52 around the lever rotating shaft 58 to cause the convex portions 53*a* of the staple mounting magazine to move to the vertical portion 71*a* of the paper end guide 71 to fit the convex portions 53*a* of the staple mounting magazine 53 into the shift preventive concave portion 71*g* formed on the vertical portion 71*a* so that the staple mounting magazine 53 cannot descend still further. By rotating the operating handle 52 still further in this state, the staple pushing blade (not shown) provided inside the staple mounting magazine 53 is brought down to discharge a staple from the staple discharge port 53*h* to complete pushing staples on a trial basis.

In order to staple a paper bundle in a normal manner again, the paper end guide 71 is caused to move in a direction opposite to an arrow in FIG. 13A to arrange the vertical portion 71*a* of the paper end guide 71 apart from below the convex portions 53*a* to engage the engaging claw 71*f* with the engaged concave portions 51*d*.

If, in this state, the operator rotates the operating handle 52 around the lever rotating shaft 58, the staple mounting magazine 53 comes in between two vertical portions 71*a* provided in the paper end guide 71 so that the staple mounting magazine 53 can be caused to descend onto the horizontal base 51 to staple a paper bundle.

According to the stapler 70 described above, the shift preventive concave portion 71*g* is formed at the upper end 71*b* of the vertical portion 71*a* in the paper end guide 71. Thus, when the staple mounting magazine 53 is caused to descend, the convex portions 53*a* of the staple mounting magazine 53 are reliably fitted into the engaged concave portions 51*d* of the paper end guide 71. Therefore, if the staple mounting magazine 53 is caused to descend to push staples on a trial basis, since no shift can be caused after the convex portions 53*a* of the staple mounting magazine 53 are fitted into the engaged concave portions 51*d* of the paper end guide 71, the paper end guide 71 does not move on the horizontal base 51 and staples can reliably be pushed on a trial basis without causing arrangement shifts between the vertical portion 71*a* of the paper end guide 71 and the convex portions 53*a* of the staple mounting magazine 53.

Materials of the paper end guide 71 and the horizontal base 51 are not specified in the fourth embodiment of the present invention, but the present invention is not limited to the above embodiment. That is, it is possible to adopt a configuration in which magnets are provided on the back side of the paper end guide 71 and the upper surface of the horizontal base 51 is formed of an iron plate to which a magnet is attached. For example, magnets are provided on the back side of the horizontal portion 71*c* of the paper end guide 71 excluding an area of an engaging hook plate 71*d* and an area between lines of the guide rail portion 51*b* on the upper surface of the horizontal base 51 is formed from an iron plate.

Since the paper end guide 71 provided with magnets can be attached to and detached from the area between lines of the guide rail portion 51*b* formed of an iron plate, the paper end guide 71 can reliably be fixed at a location on the horizontal base 51 to which the paper end guide 71 should be moved and also the paper end guide 71 can be easily taken off and moved on the horizontal base 51.

Fifth Embodiment of the Invention

A fifth embodiment of the present invention will be described below. FIGS. 14 to 18B show the fifth embodiment of the present invention. The same reference numerals are attached to the same components as those in the first embodiment and a description thereof is not repeated.

A stapler 80 is characterized in that the staple mounting magazine 13 can be moved downward after the height of a second rotating shaft 86 in the operating handle 12 is fixed. The height of the second rotating shaft 86 in the operating handle 12 is fixed by rotating the operating handle 12. As shown in FIGS. 16 to 18, such a rotating-shaft vertical position fixing means for fixing the height of the second rotating shaft 86 includes a support member 87 set up on the horizontal base 11, a key member 82 movable along the support member 87, the fixed spring 28 to stop movement of the operating handle 12 by engaging the key member 82 with the support member 87, a bearing member 81 supporting the key member 82, a hole 81*e* (See FIGS. 15C and 15D) formed in the bearing member 81 to be inserted through by the second rotating shaft 86 of the operating handle 12, and the second rotating shaft 86 of the operating handle 12.

Figure 14:
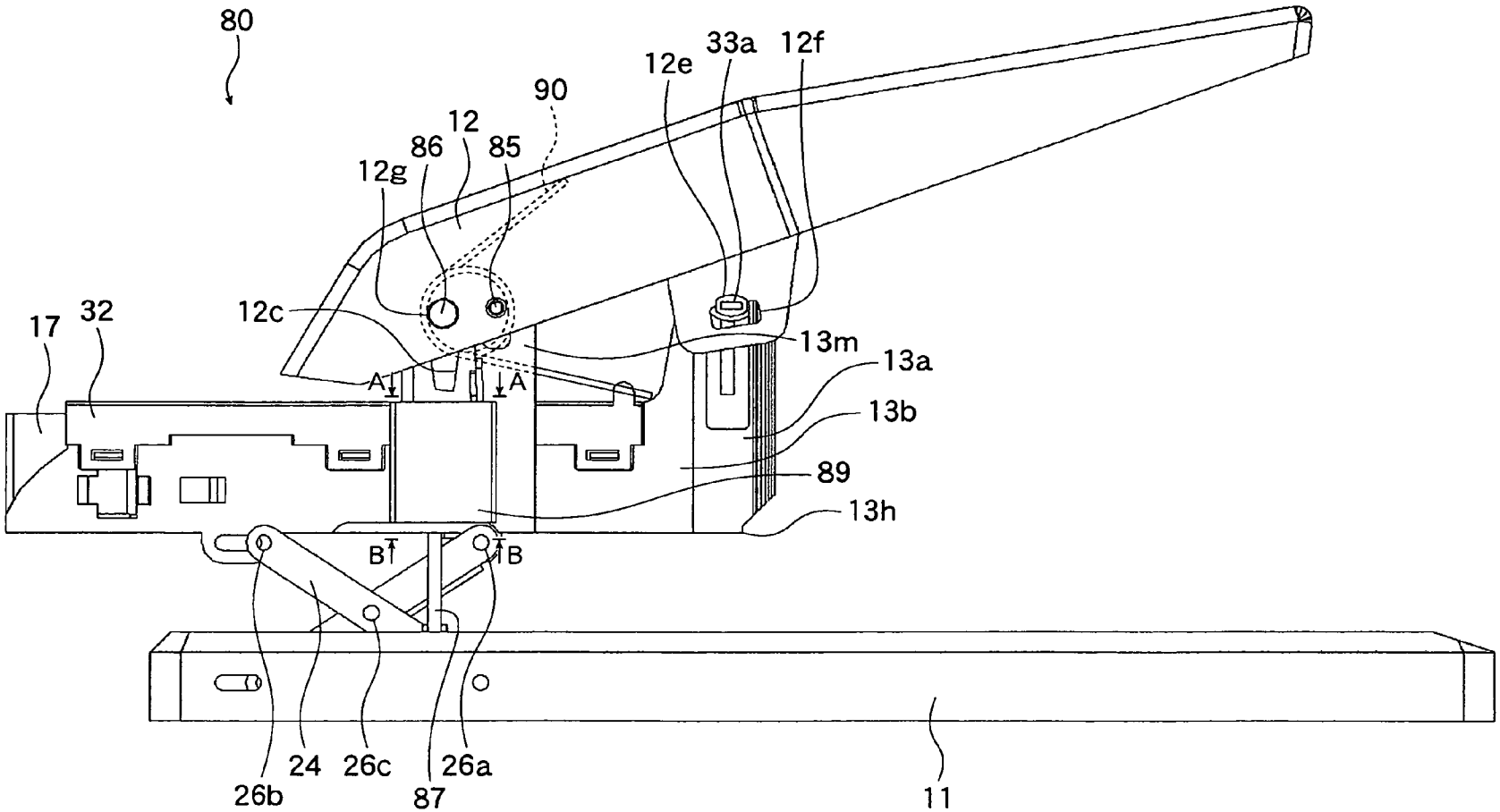
FIG. 14 is a side view of a stapler according to a fifth embodiment of the present invention.
Figure 15A:
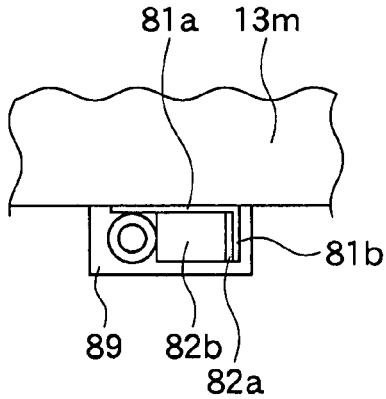
FIGS. 15A to 15D show configuration of a key member housing portions or support members according to the fifth embodiment.
Figure 15B:
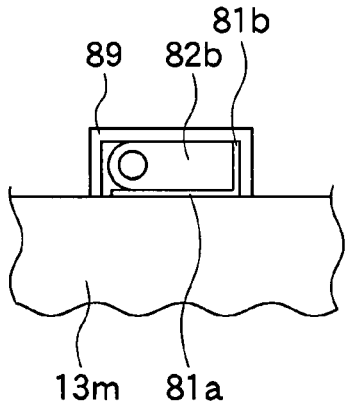
Figure 15C:
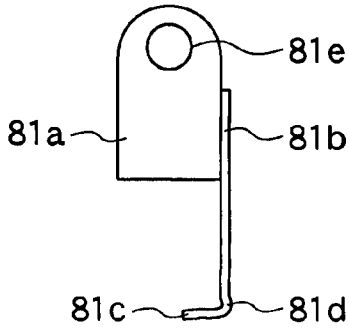
Figure 15D:
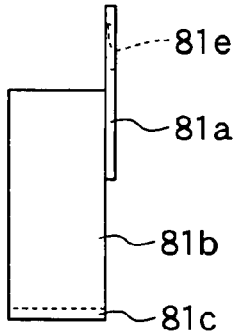

In the stapler 80, as shown in FIG. 14, the operating handle 12 is fastened to a bearing member 13*m* of the staple mounting magazine 13 by a first rotating shaft 85 and the second rotating shaft 86.

As shown in FIGS. 16 to 18, the first rotating shaft 85 is inserted into a first bearing portion 13*p* formed in the bearing member 13*m* held by the staple mounting magazine 13, and the second rotating shaft 86 is inserted into a second bearing portion 13*q* formed in the bearing member 13*m* held by the staple mounting magazine 13.

The first bearing portion 13*p* is formed in an elongated hole and the first rotating shaft 85 inserted therethrough acts as a rotation center of the operating handle 12 until the height of the second rotating shaft 86 of the operating handle 12 is fixed. The second bearing portion 13*q* is formed in an elongated hole and the second rotating shaft 86 inserted therethrough acts as a rotation center of the operating handle 12 after the height of the second rotating shaft 86 of the operating handle 12 is fixed.

As shown in FIG. 14, a spring member 90 in a V-shape is provided between the operating handle 12 and the staple mounting magazine 13 to transmit a load on the operating handle 12 to the staple mounting magazine 13. One end of the spring member 90 is slidably attached to the back side of the operating handle 12, and the other end of the spring member 90 is slidably attached to the upper surface of the staple mounting magazine 13. When viewed from a side, the spring member 90 has two linear portions and a twist portion between the two linear portions with elasticity.

In the stapler 80, as shown in FIGS. 16 to 18, the key member 82 is provided in a key member housing portion 89. The key member 82 includes a vertical portion 82*a* and an engaging plate 82*b* bent from the lower end portion of the vertical portion 82*a* and having an insertion hole 82*c* with which the support member 87 can engage, and is formed in an L cross-sectional shape. The key member 82 also has a corner 82*d* between the vertical portion 82*a* and engaging plate 82*b*.

In the stapler 80, as shown in FIGS. 16A to 18B, the bearing member 81 includes a fixed portion 81*a*, a support plate 81*b* formed by bending from the fixed portion 81*a*, and a horizontal portion 81*c* formed by bending from the lower end of the support plate 81*b*, and has a support corner 81*d* between the support plate 81*b* and horizontal portion 81*c*. The bearing member 81 also has a hole 81*e* (See FIGS. 15C and 15D) formed with the same diameter as that of the second rotating shaft 86 and is fixed to the bearing member 13*m* by inserting the second rotating shaft 86 through the hole 81*e* and the second bearing portion 13*q* formed in the bearing member 13*m*.

With such a configuration, the corner 82*d* of the key member 82 is supported by bringing the corner 82*d* into contact with the support corner 81*d* of the bearing member 81.

Next, operations of the stapler 80 in the fifth embodiment of the present invention will be described.

Figure 16B:
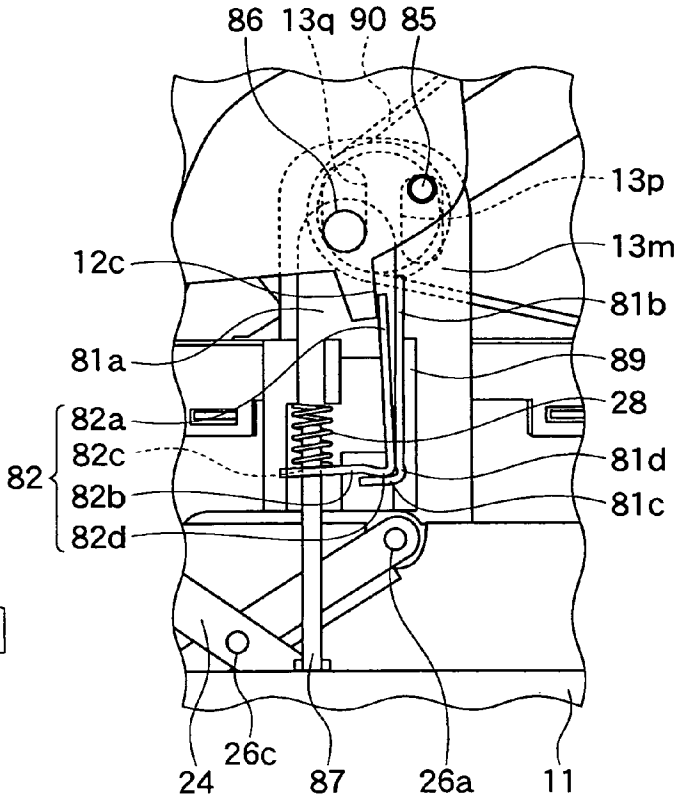
FIGS. 16A to 16B are structural views showing states of the key member and support member in the fifth embodiment when the operating handle is not pressed.
Figure 16A:
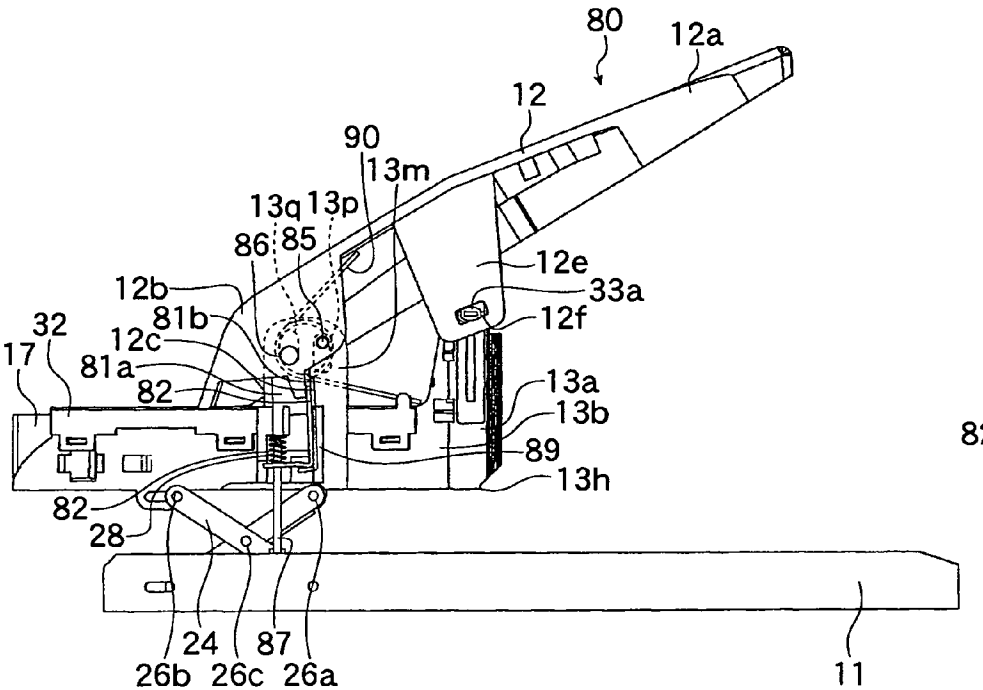

As shown in FIG. 16A to 16B, the operating handle 12 is tilted at a predetermined angle in an initial state and, at this point, the first rotating shaft 85 is in contact with the upper end inside the first bearing portion 13*p* and the second rotating shaft 86 is in contact with the lower end inside the second bearing portion 13*q*.

Figure 17B:
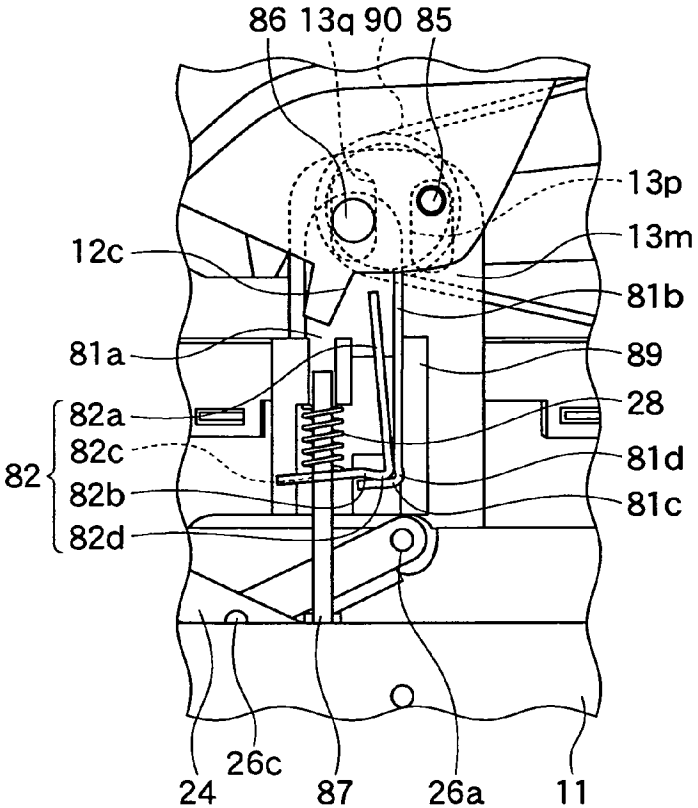
FIGS. 17A to 17B are structural views showing states of the key member and support member in the fifth embodiment when the operating handle is pressed, a height of a second rotating shaft of the operating handle is fixed, and then the operating handle is rotated.

Next, if a paper bundle is placed on the horizontal base 11 of the stapler 80 and the handle tip portion 12*a* of the operating handle 12 is pressed, the operating handle 12 rotates around the first rotating shaft 85 and the blade pusher 33 descends along the blade guide portion 13*a* from a state of FIG. 16 to that of FIG. 17. The handle base end 12*b* of the operating handle 12 is lifted using the fitting member 33*a* of the blade pusher 33 as a fulcrum while the operating handle 12 descends, and the first rotating shaft 85 slightly descends, from a state in which the first rotating shaft 85 is in contact with the upper end of the first bearing portion 13*p*, as shown in FIG. 16B, inside the first bearing portion 13*p*, as shown in FIG. 17B. At the same time, the second operating shaft 86 ascends, from a state in which the second rotating shaft 86 is in contact with the lower end of the second bearing portion 13*q*, as shown in FIG. 16B, inside the second bearing portion 13*q*, as shown in FIG. 17B.

At this point, as shown in FIG. 16B, the key member 82 is tilted using the corner 82*d* as a center while leaning toward the load transmission portion 12*c* of the operating handle 12. Then, by further pressing the operating handle 12, leaning toward the load transmission portion 12*c* of the operating handle 12 is released, as shown in FIG. 17B, and the insertion hole 82*c* of the key member 82 is engaged with the support member 87 provided on the horizontal base 11. With the position of the key member 82 being fixed as described above, the height of the bearing member 81 is simultaneously fixed and the height of the second rotating shaft 86 is fixed while the hole 81*e* formed in the bearing member 81 inhibits vertical movement of the second rotating shaft 86. When the height of the second rotating shaft 86 is fixed, the operating handle 12 cannot make a translational motion in the vertical direction. When the key member 82 is engaged with the support member 87 and the operating handle 12 is locked, the center around which the operating handle 12 rotates changes from the first rotating shaft 85 to the second rotating shaft 86.

Even though the key member 82 is engaged with the support member 87 and the operating handle 12 is locked, as described above, if paper sheets are not even and slightly uneven, for example, air is contained between paper of a paper bundle, the paper bundle should be stapled after pressing the paper bundle to make it more even by causing the staple mounting magazine 13 to descend further.

Figure 17A:
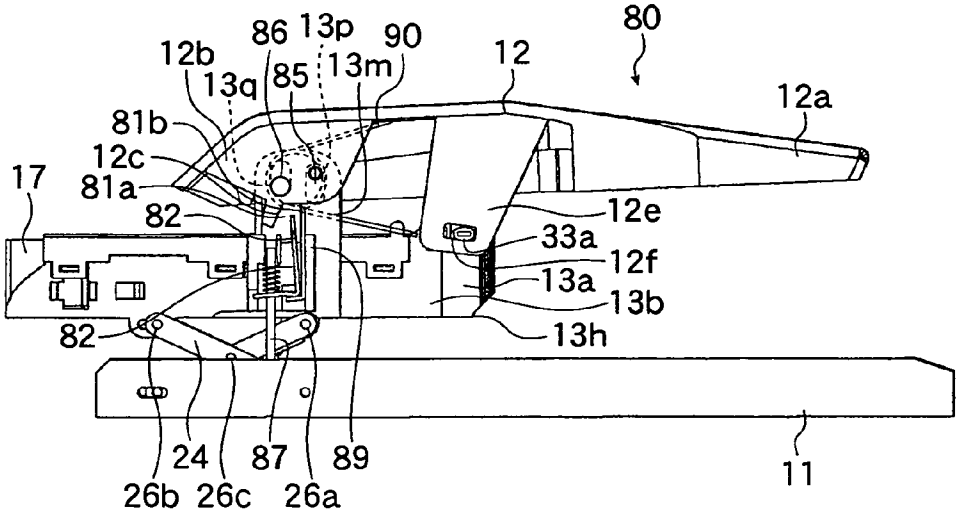
Figure 18B:
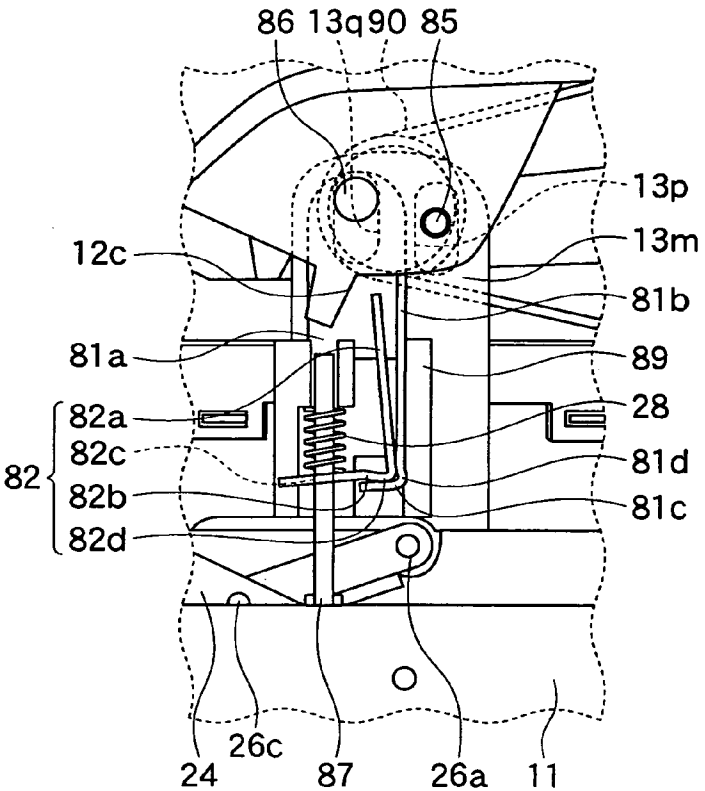
FIGS. 18A to 18B are structural views showing states of the key member and support member in the fifth embodiment when the height of the second rotating shaft of the operating handle is fixed, and then the operating handle is further pressed to rotate.
Figure 18A:
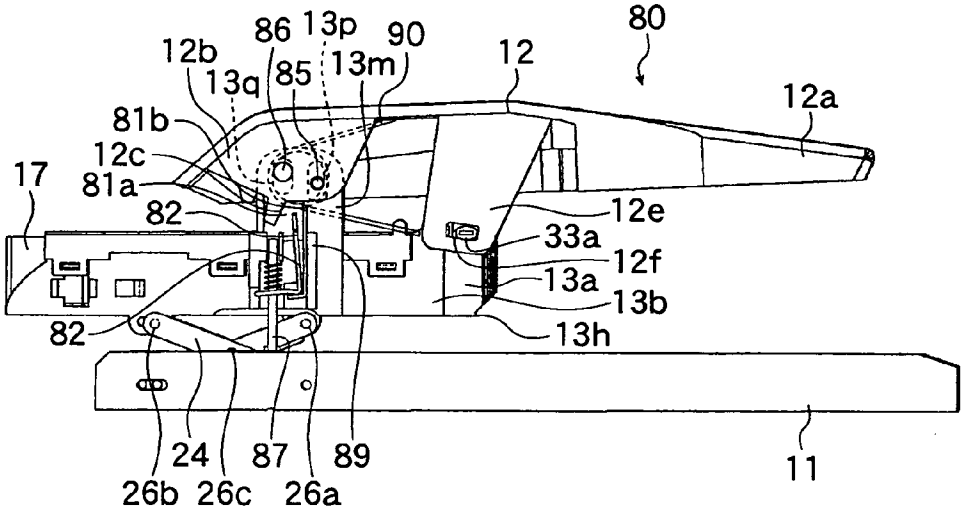

For that purpose, if the operating handle 12 is further pressed after the staple mounting magazine 13 is caused to come into contact with the paper bundle, the operating handle is rotated around the second rotating shaft 86 from the state of FIGS. 17A, 17B to that of FIGS. 18A, 18B and the staple mounting magazine 13 is caused to descend slightly by a force of the spring member 90 pressing down the staple mounting magazine 13, thereby allowing to staple the paper bundle while pressing the paper bundle to make it more even.

At this point, the height of the second rotating shaft 86 does not change, but since the staple mounting magazine 13 descends due to a pressing force of the spring member 90 on the staple mounting magazine 13, the position of the second bearing portion 13*q* descends with respect to the second rotating shaft 86 and thus the second rotating shaft 86 seems to rise inside the second bearing portion 13*q*. At the same time, the first rotating shaft 85 descends inside the first bearing portion 13*p* by rotating around the second rotating shaft 86.

According to the stapler 80 described above, the support member 87 fixing the height of the second rotating shaft 86 of the operating handle 12 by starting rotation of the operating handle 12, key member 82, fixed spring 28, bearing member 81, hole 81*e*, and second rotating shaft 86 are provided. Thus, it can be made easier to recognize a timing when a staple can be pushed vertically into a paper bundle.

Also, the support member 87 set up on the horizontal base 11, key member 82 movable along the support member 87, bearing member 81 supporting the key member 82, hole 81*e* formed in the bearing member 81 to be inserted through by the second rotating shaft 86 of the operating handle 12, and second rotating shaft 86 of the operating handle 12 are provided. Thus, the key member 82 is engaged with the support member 87, and the bearing member 81 is fixed by fixing the key member 82, thereby fixing the second rotating shaft 86 of the operating handle 12 that is inserted through the hole 81*e* of the bearing member 81 and the operating handle 12. Therefore, the position of the operating handle 12 with respect to the horizontal base 11 can be fixed.

The spring member 90 to transmit a pressing force applied to the operating handle 12 to the staple mounting magazine 13 is provided between the operating handle 12 and staple mounting magazine 13. Thus, an energizing force in a downward direction from the operating handle 12 to the staple mounting magazine 13 arises by the spring member 90 after the height of the operating handle 12 relative to the horizontal base 11 is fixed, enabling the staple mounting magazine 13 to descend. Therefore, the paper bundle can be further pressed by the staple mounting magazine 13 so that the paper bundle can be stapled reliably and neatly.

The fixed spring 28 to assist the key member 82 in engagement with the support member 87 is in contact with the key member 82 to strengthen the force of the key member 82 to engage with the support member 87. Therefore, the key member 82 cannot descend or ascend from a predetermined position of the support member 87.

Further, the key member 82 includes the vertical portion 82*a* and the engaging plate 82*b* bent from the lower end portion of the vertical portion 82*a* and having the insertion hole 82*c* with which the support member 87 can engage, and is formed in an L cross-sectional shape, the key member housing portion 89 in which the support member 87 and key member 82 are housed is provided in the staple mounting magazine 13, and the bearing member 81 supporting the key member 82 is provided in the key member housing portion 89. Therefore, the key member 82 is formed in the L cross-sectional shape and thus the key member 82 can be made to have an easy-to-mold and simple structure.

The spring member 90 is formed in a V-shape, and one end of the spring member 90 is attached to the operating handle 12 and the other end of the spring member 90 is attached to the staple mounting magazine 13 between the operating handle 12 and the staple mounting magazine 13. Thus, the staple mounting magazine 13 can be made to have a reasonable and easy-to-form structure.

DESCRIPTION OF REFERENCE NUMERALS

10, 40, 50, 70, 80: Stapler
11, 51: Horizontal base
12, 52: Operating handle
12*c*: Load transmission portion
12*f*: Support hole
12*k*: guidance slotted hole
13, 53: Staple mounting magazine
15: Staple pushing blade
16: Staple connecting assembly
17: Staple connecting assembly cassette
18: Handle spring (post-vertical movement rotating means) (rotation direction elastic member)
21: Key member (magazine vertical position fixing means)
21*a*: Vertical portion
21*b*: Load receiving portion
21*c*: Engaging plate
21*d*: Insertion hole

22: Support member (magazine vertical position fixing means)
24: Pantograph (vertical movement means)
27: Pantograph spring (post-vertical movement rotating means) (vertical direction elastic member)
28: Fixed spring (vertical position fixing means)
31: Rotating shaft
33*a*: Fitting member
51*b*: Guide rail portion
51*c*: Engaged convex portion
51*d*: Engaged concave portion
53*a*: Convex portion
53*h*: Staple discharge port
61*a*, 71*a*: Vertical portion
61*b*, 71*b*: Upper end
61*c*: Horizontal portion
71*f*: Engaging claw
71*g*: Shift preventive concave portion
81: Bearing member (rotating shaft vertical position fixing means)
81*e*: Hole (rotating shaft vertical position fixing means)
82: Key member (rotating shaft vertical position fixing means)
13*p*: First bearing portion
13*q*: Second bearing portion
85: First rotating shaft
86: Second rotating shaft
87: Support member (rotating shaft vertical position fixing means)
89: Key member housing portion
90: Spring member (elastic member)

The invention claimed is:

1. A stapler including a horizontal base, an operating handle arranged by tilting to a predetermined angle with respect to the horizontal base, a staple mounting magazine attached to the operating handle to mount a staple connecting assembly cassette housing a staple connecting assembly that connects staples, and a staple pushing blade which is brought down on a staple housed in the staple mounting magazine, the stapler comprising:

a vertical movement section for causing the operating handle to vertically descend together with the staple mounting magazine by pressing the operating handle while keeping the operating handle at a predetermined angle; and a post-vertical movement rotating section that starts rotation of the operating handle after the staple mounting magazine vertically descends to come into contact with a paper bundle placed on the horizontal base, wherein the vertical movement section is a pantograph causing the staple mounting magazine to descend and ascend on the horizontal base.

2. The stapler according to claim 1, further comprising:

a magazine vertical position fixing section for fixing a vertical position of the staple mounting magazine by starting the rotation of the operating handle.

3. The stapler according to claim 2, wherein the post-vertical movement rotating section comprises a vertical direction elastic member supporting the staple mounting magazine and a rotation direction elastic member rotating the operating handle, and the rotation direction elastic member elastically deforms to start the rotation of the operating handle after the vertical direction elastic member elastically deforms and the operating handle descends together with the staple mounting magazine to come into contact with the paper bundle while keeping the operating handle at a predetermined angle.

4. The stapler according to claim 2, wherein the magazine vertical position fixing section comprises a support member set up on the horizontal base and a key member movable along the support member, and a position in a vertical direction of the staple mounting magazine is fixed with the key member being engaged with the support member.

5. The stapler according to claim 4, wherein a fixed spring assisting in engagement with the support member is in contact with the key member to strengthen a force of the key member to engage with the support member.

6. The stapler according to claim 4, wherein the key member comprises a vertical portion, a load receiving portion bent at an upper end portion of the vertical portion to receive a load of the operating handle, and an engaging plate portion bent at a lower end portion of the vertical portion and having an insertion hole with which the support member can be engaged and is formed in a C cross-sectional shape.

7. The stapler according to claim 6, wherein the fixed spring is compressed and disposed at a place between a bearing portion of the support member formed in a key member housing portion housing the key member and the support member provided in the staple mounting magazine and the engaging plate.

8. The stapler according to claim 6, wherein a load transmission portion to transmit a load on the operating handle to the key member is formed in the operating handle, the load receiving portion and the load transmission portion are provided face to face with each other, the load transmission portion moves away from the load receiving portion, the engaging plate and the support member engage with each other, and movement of the key member with respect to the support member is stopped when the operating handle is rotated, and the load transmission portion is pushed against the load receiving portion to release engagement between the engaging plate and the support member, and the key member can move with respect to the support member when the operating handle is not rotated.

9. The stapler according to claim 2, wherein a blade pusher pressing to cause the staple pushing blade to descend is rockable without support of an upper end portion thereof by the operating handle, and a convex portion formed in an area other than the upper end portion is supported by the operating handle.

10. The stapler according to claim 9, wherein the convex portion is an insertion convex portion formed on the blade pusher, the insertion convex portion is inserted through a guidance slotted hole formed inside a blade guide portion of the staple mounting magazine and fitted into a fitting member, and a support hole to support the fitting member is formed in the staple mounting magazine so that the operating handle rotates while the fitting member and the support hole are at least in point contact.

11. The stapler according to claim 9, wherein a position of a midway point between an upper end and a lower end of positions where the convex portion moves before and after descent/ascent by an operation of the operating handle is approximately as high as the rotating shaft of the operating handle.

12. The stapler according to claim 2, wherein the staple mounting magazine descends a predetermined distance upon the operating handle being further pressed after the staple mounting magazine comes into contact with the paper bundle.

13. A stapler including a horizontal base, an operating handle arranged by tilting to a predetermined angle with respect to the horizontal base, a staple mounting magazine attached to the operating handle to mount a staple connecting assembly cassette housing a staple connecting assembly that connects staples, and a staple pushing blade which is brought down on a staple housed in the staple mounting magazine, the stapler comprising:

a vertical movement section for causing the operating handle to vertically descend together with the staple mounting magazine by pressing the operating handle while keeping the operating handle at a predetermined angle;

a post-vertical movement rotating section that starts rotation of the operating handle after the staple mounting magazine vertically descends to come into contact with a paper bundle placed on the horizontal base; and a rotating shaft vertical position fixing section for fixing a height of a rotating shaft of the operating handle by starting rotation of the operating handle, wherein the rotating shaft vertical position fixing section comprises a support member set up on the horizontal base, a key member movable along the support member, a bearing member supporting the key member, a hole formed in the bearing member to be inserted through by the rotating shaft of the operating handle, and the rotating shaft of the operating handle.

14. The stapler according to claim 13, wherein an elastic member for transmitting a pressing force applied to the operating handle to the staple mounting magazine is provided between the operating handle and the staple mounting magazine.

15. The stapler according to claim 14, wherein the elastic member is a spring member in a V-shape, and between the operating handle and the staple mounting magazine, one end of the spring member is attached to the operating handle and another end of the spring member is attached to the staple mounting magazine.

16. The stapler according to claim 13, wherein a fixed spring assisting in engagement with the support member is in contact with the key member to strengthen a force of the key member to engage with the support member.

17. The stapler according to claim 13, wherein the key member comprises a vertical portion and an engaging plate bent from a lower end portion of the vertical portion to have an insertion hole with which the support member can engage and formed in an L cross-sectional shape, a key member housing portion in which the support member and the key member are housed is provided in the staple mounting magazine, and the bearing member supporting the key member is provided in the key member housing portion.

* * * * *